US005376773A

United States Patent [19]

Masuda et al.

[11] Patent Number: 5,376,773

[45] Date of Patent: Dec. 27, 1994

[54] HEATER HAVING HEAT GENERATING RESISTORS

[75] Inventors: Kazunori Masuda, Kawasaki; Hiroshi Kondo, Yokohama, both of Japan

[73] Assignee: Canon Kabushiki Kaisha, Tokyo, Japan

[21] Appl. No.: 997,544

[22] Filed: Dec. 28, 1992

[30] Foreign Application Priority Data

Dec. 26, 1991 [JP] Japan ..... 3-344530
Mar. 19, 1992 [JP] Japan ..... 4-093599

[51] Int. Cl.[5] ..... H05B 3/00

[52] U.S. Cl. ..... 219/543; 219/216; 219/486; 355/285; 338/308

[58] Field of Search ..... 219/543, 216, 486, 494; 355/285, 289, 290; 338/307, 308, 309, 25

[56] References Cited

U.S. PATENT DOCUMENTS

| | | | |
|---|---|---|---|
| 2,629,166 | 2/1953 | Marsten et al. | 338/307 |
| 4,675,509 | 6/1987 | Hell | 219/486 |
| 4,952,781 | 8/1990 | Kozaiku | 219/216 |
| 4,998,121 | 3/1991 | Koh et al. | 219/216 |
| 5,041,718 | 8/1991 | d'Hondt et al. | 355/290 |
| 5,053,806 | 10/1991 | Haigo et al. | 355/285 |
| 5,079,409 | 1/1992 | Takada et al. | 219/216 |
| 5,171,969 | 12/1992 | Nishimura et al. | 219/216 |
| 5,177,341 | 1/1993 | Balderson | 219/543 |

*Primary Examiner*—Bruce A. Reynolds
*Assistant Examiner*—Gregory L. Mills
*Attorney, Agent, or Firm*—Fitzpatrick, Cella, Harper & Scinto

[57] ABSTRACT

A heater apparatus includes an electrically insulative base plate and a plurality of independent resistors, extending along a length of the base plate, for producing heat upon electric energization thereof. A temperature detecting element detects a temperature of the base plate, and a controller controls a supply of electric power to the plurality of independent resistors so that the temperature detected by the detecting element approaches a predetermined temperature. A selecting device selects at least one of the resistors to be energized to change a resultant resistance of the selected resistors in accordance with an output of the detecting element.

12 Claims, 26 Drawing Sheets

HEATER HAVING HEAT GENERATING RESISTORS

FIELD OF THE INVENTION AND RELATED ART

The present invention relates to a heater and a heating apparatus for suitably use for fixing images in an image forming apparatus such as a copying machine, a printer or the like.

Referring first to FIG. 13, there is shown a conventional heater having a base plate 4 and one resistor 1 as a heat generating source disposed at a center of an image fixing surface. To the opposite ends of the resistor 1, conductive leads 9 and 10, which are connected to connection contacts 5 and 6. By changing the electric power supplies to the heater. the constant temperature control is effected.

In FIG. 17, there is shown a temperature control device for the heater. The heater H is provided with a resistor 1 or the like, and the electric power supply from an AC power source to the resistor 1 is controlled by switching element 35. The temperature information from a thermister 36 for detecting the temperature of the heater is converted to a digital signal by A/D converter 37. The signal is supplied to a microcomputer 38, which produces control information to a control circuit 39 to provide a predetermined temperature in accordance with the temperature information received. The control circuit 39 controls the switching element 35.

When the applied voltage to the heater or the electric current thereto is controlled, the circuit is complicated, and relatively large electric power consumption is required in the circuit other than that including the heater, and therefore, the period of electric power supply to the heater is generally controlled in a predetermined period, that is, the duty ratio is controlled. As for the control method for the energization period, there have been proposed the following two systems. In one of them, energization and deenergization are controlled for each of the half-waves of the wave form of the power supply shown in FIG. 14 (zero-cross wave number control). In the second method, a phase angle of the electric power supply is controlled for each of hte half waves of the wave form shown in FIG. 15 (phase control system).

However, the conventional control systems involve the following problems.

In the zero-cross wave number control (the first system), only two levels (on/off) are usable as the electric power supply usable for the control of the heater temperature in the half wave of the voltage source. Therefore, in order to accurately control the temperature, a block is provided including a plurality of half waves, and the on/off pattern is predetermined, or the duty of the on/off is predetermined in the block.

However, such block control, requires a relatively large response period, with the result of large ripple of the heater temperature. In addition, when the on-off switching is carried out for each of the half waves, a harmonic wave component is generated in the load current with the result of voltage source noise. Adjacent 90 degrees of the energization phase angle, the current increases very steeply with the result of a large level of switching noise. Similarly to the case of the zero-cross wave number control, a harmonic noise component is produced.

SUMMARY OF THE INVENTION

Accordingly, it is a principal object of the present invention to provide a heater with small ripple during constant temperature control.

It is another object of the present invention to provide a heater in which generation of harmonic wave noise is suppressed.

According to an aspect of the present invention, there is provided a heater apparatus, comprising: an electrically insulative base plate; a plurality of independent resistors, extending along a length of said base plate, for producing heat upon electric energization thereof; a common electrode commonly connected to one ends of said resistors; and electrodes connected to the other ends of the respective independent electrodes.

According to a further aspect of the present invention, there is provided a heating apparatus comprising: an electrically insulative base plate; a plurality of independent resistors, extending along a length of said base plate, for producing heat upon electric energization thereof; temperature detecting element for detecting a temperature of said base plate; and selecting means for selecting one or more of said resistors to be energized in accordance with an output of said detecting element.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
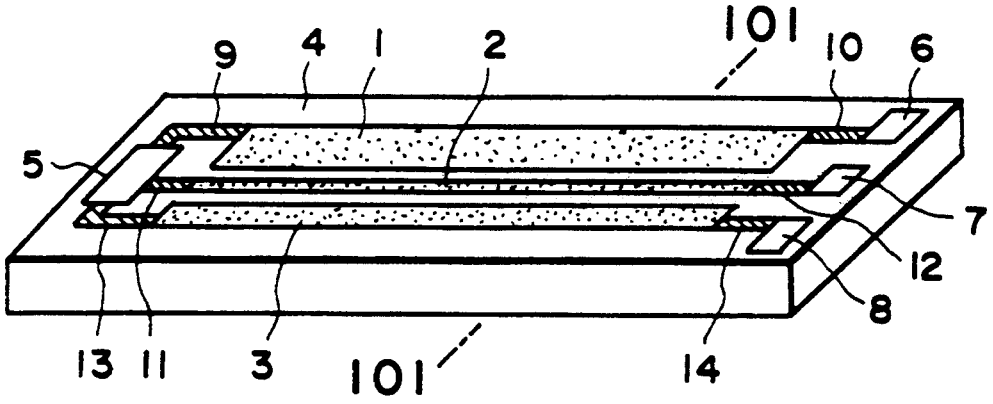
FIG. 1 is a perspective view of a heater for an image fixing device according to an embodiment of the present invention.

FIG. 1 shows a heater according to a first embodiment of the present invention.

Figure 2:
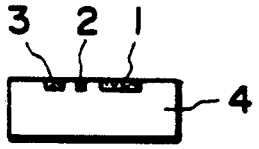
FIG. 2 is a sectional view taken along a line A—A in FIG. 1.

FIG. 2 is a sectional view taken along a line A—A of FIG. 1.

In FIG. 1, the heater comprises resistors 1, 2 and 3, an insulating base plate 4, contacts 5, 6, 7 and 8 for external connection, and conductive leads 9–14. The base plate 4 is made from a material such as ceramic or the like having electrically insulative nature and having high thermal conductivity. On the surface thereof, resistors 1–3 are juxtaposed with proper spacings therebetween. Opposite ends of the resistors 1–3, are connected to the respective conductive leads 9–14.

The conductive leads 9, 11 and 13 at one ends of the resistors 1–3, are connected to a common contact 5, and the conductive leads 10, 12 and 14 at the other sides are connected to the contacts 6–8, respectively. The contacts 6–8 are connected to switches outside the heater, so that the load resistance of the heater can be changed in accordance with actuation and deactuation of the switches.

The resistances of the resistors 1–3 per unit length may be the same or different. However, in order to reduce the number of the resistors with large number of variable resistances of the heater, it is desirable that the resistors have different resistances.

In this embodiment, the heater comprises three resistors 1–3. Where the ratio of the resistances is 1:2:4, for example, the resistance of the heater can take three different levels, namely, 1/7, 1/6, . . . ,½, 1 and infinity. The heat generating power can take eight levels, selectively.

FIGS. 3–7 shows a heater device according to a second embodiment of the present invention.

Figure 3:
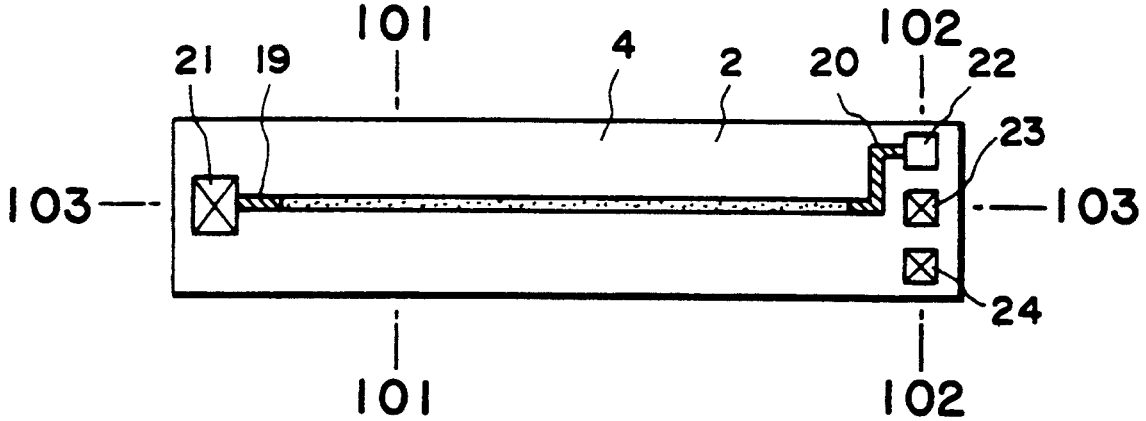
FIG. 3 is a top plan view of a heating device for an image fixing device according to a second embodiment of the present invention.
Figure 4:
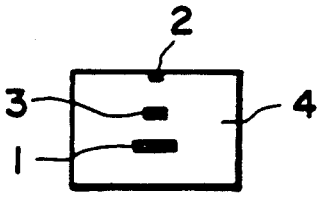
FIG. 4 is a sectional view taken along a line A—A in FIG. 3.
Figure 5:
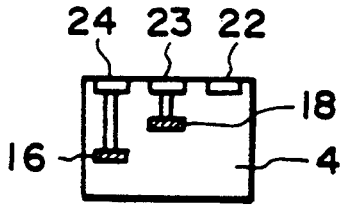
FIG. 5 is a sectional view taken along a line B—B in FIG. 3.
Figure 6:
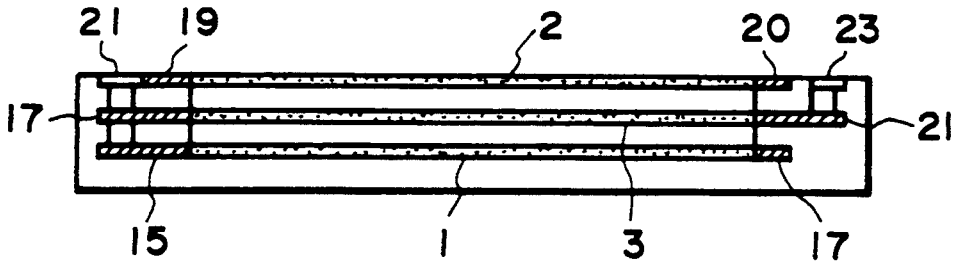
FIG. 6 is a sectional view taken along a line C—C in FIG. 3.
Figure 7:
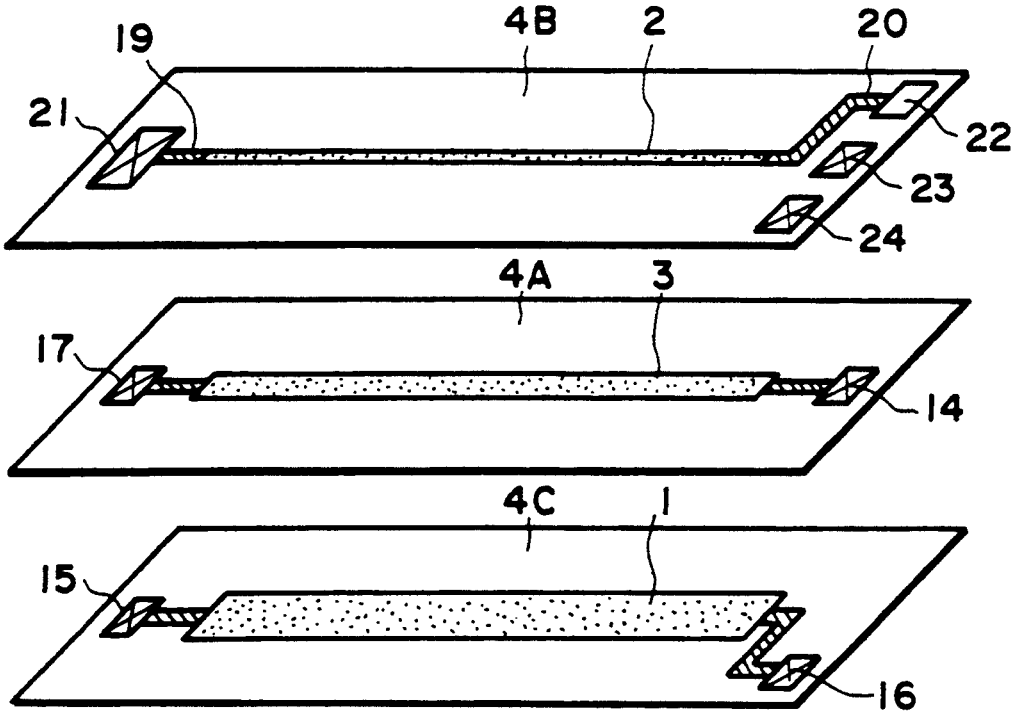
FIG. 7 is an exploded perspective view of the device of FIG. 3.

FIG. 3 is a top plan view of the heater; FIG. 4 is a sectional view taken along a line A—A of FIG. 3; FIG. 5 is a sectional view taken along a line B—B of FIG. 3; FIG. 6 is a sectional view taken along a line C—C of FIG. 3; FIG. 7 is an exploded perspective view illustrating the laminated structure of the heater of FIG. 3 according to the second embodiment of the present invention. On the base plate 4 made of ceramic or the like having an electrically insulative property and having a high thermal conductivity, a first resistor 1 is formed, and the opposite ends of the resistor 1 are connected to the wiring leads 15 and 16. An insulating layer 4A is laminated thereon, and a second resistor 3 is formed on the insulative layer 4A. The opposite ends of the resistor 3 is connected to wiring leads 17 and 18. Further thereon, an insulating layer 4B is laminated, and a third resistor 2 is formed on the insulative layer 4B. The opposite ends of the resistor 2 are connected to the lead 19 and 20. There are provided contacts 21–24 for external electric connections.

The contact 21 is in contact with the lead 19, and is connected to the leads 17 and 15 below it through a through hole or the like.

The contact 22 is connected with the lead 20, and the contact 23 is connected to the lead 18 in the middle layer through a through hole or the like. The contact 24 is connected to the lead 16 below it through a through hole or the like.

The resistors 1, 2 and 3 on the insulative base plate 4 and the insulative layers 4A and 4B, are arranged three-dimensionally in the direction of the thickness of the heater. One side ends thereof are electrically connected with each other and are connected to one contact. The other ends are connected to the respective resistors. The multi-layer heater is constructed in this manner.

Figure 8:
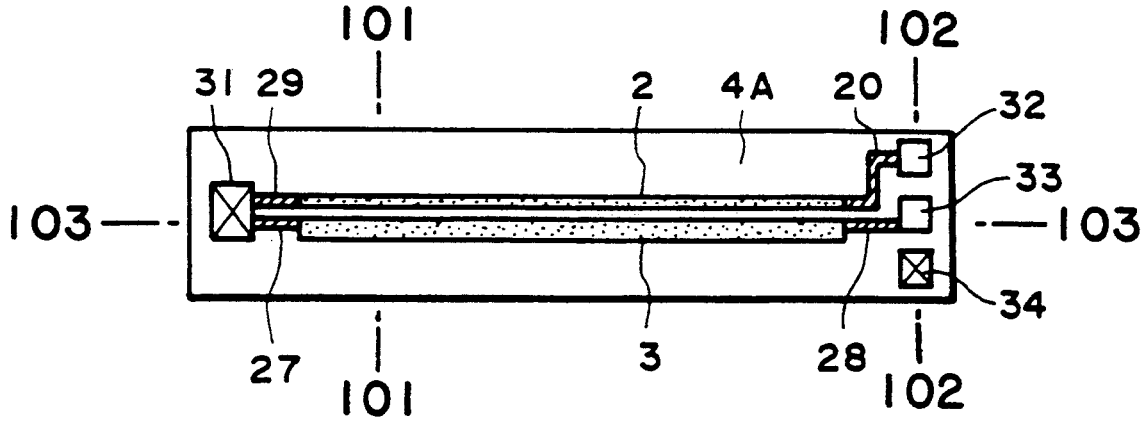
FIG. 8 is a top plan view of a heater device for an image fixing apparatus according to a third embodiment of the present invention.
Figure 9:
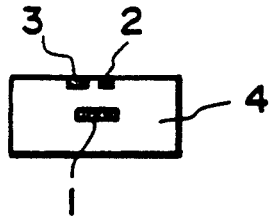
FIG. 9 is a sectional view taken along a line A—A of FIG. 8.
Figure 10:
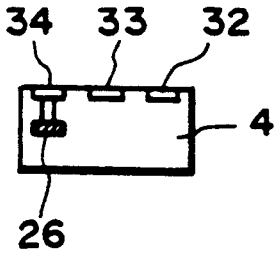
FIG. 10 is a sectional view taken along a line B—B of FIG. 8.
Figure 11:
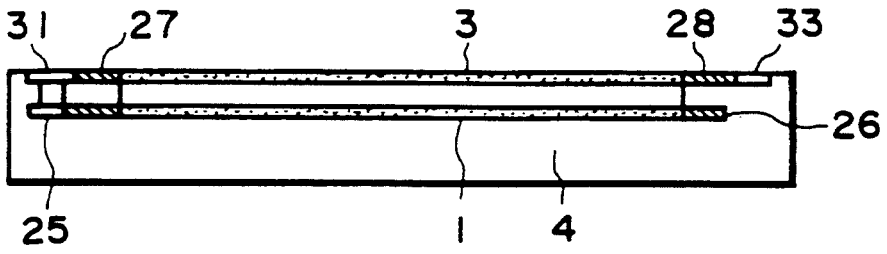
FIG. 11 is a sectional view taken along a line C—C of FIG. 8.
Figure 12:
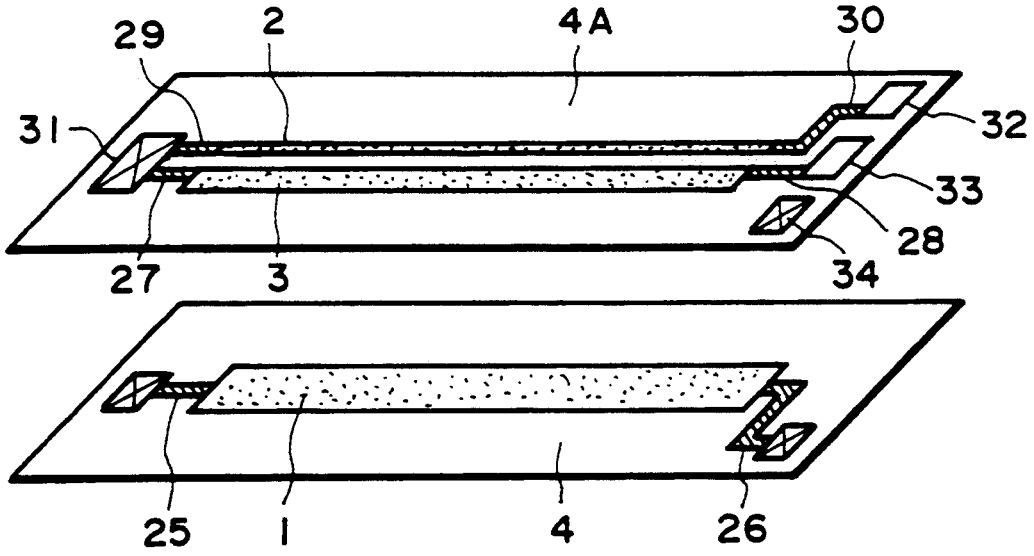
FIG. 12 is an exploded perspective view of the apparatus of FIG. 8.
Figure 13:
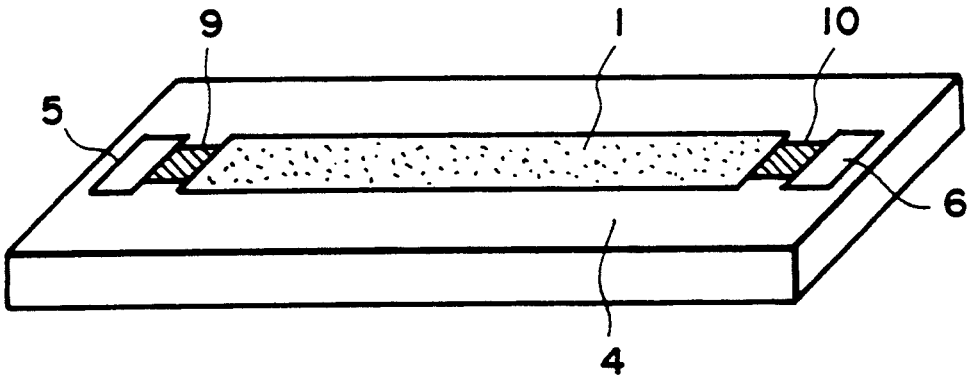
FIG. 13 PRIOR ART
FIG. 13 is a perspective view of a conventional heater.
Figure 14:
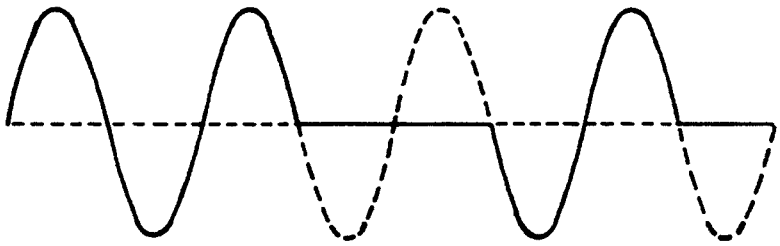
FIG. 14 PRIOR ART
FIG. 14 shows a current wave used in a zero-cross wave number control.
Figure 15:
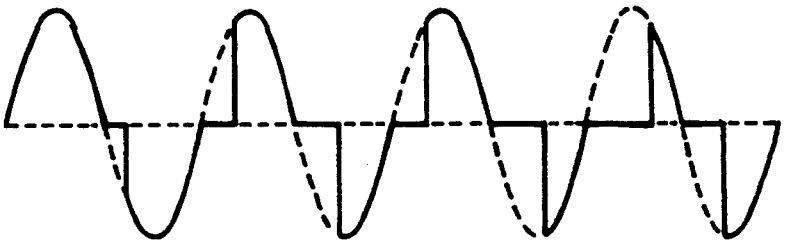
FIG. 15 PRIOR ART
FIG. 15 shows a current wave used in a phase control system.

FIGS. 8–12 show a heater according to a third embodiment of the present invention. FIG. 8 is a top plan view of the heater; FIG. 9 is a sectional view taken along a line A—A of FIG. 8; FIG. 10 is a sectional view taken along a line B—B of FIG. 8; FIG. 11 is a sectional view taken along a line C—C of FIG. 8; and FIG. 12 shows a laminated structure of the heater according to the third embodiment of the present invention, shown in FIG. 8.

A first resistor 1 is formed on the base plate 4, and the opposite ends of the resistor 1 are connected to the leads 25 and 26. An insulative layer 4A is laminated thereon, and second and third resistors 3 and 2 are juxtaposed on the insulative layer 4A. The opposite ends of the resistor 3 are connected to the leads 27 and 28. The opposite ends of the resistor 2 are connected to the conductive wires 29 and 30. There are provided electric contacts 31–34 for the external wiring. The contact 31 is connected with the leads 27 and 29, and are connected with the lead 25 below it through a through hole or the like. The contact 32 is connected with the conductive lead 30, and the contact 33 is connected with the lead 28. The contact 34 is connected with the conductive lead 26 below it through a through hole or the like.

The plurality of the resistors are arranged in a planar fashion and also in a three dimensional fashion through the insulative layer, using the first resistor 1 on the insulative base plate 4, the second and third resistors 2 and 3 juxtaposed on the insulative layer 4A. The ends at one side are electrically connected to a common contact, and the ends at the other side are connected to the respective contacts. The heater is constructed in this manner.

In the foregoing embodiments, the number of resistors is 3, but this number is not limiting and may be two or more.

Figure 16:
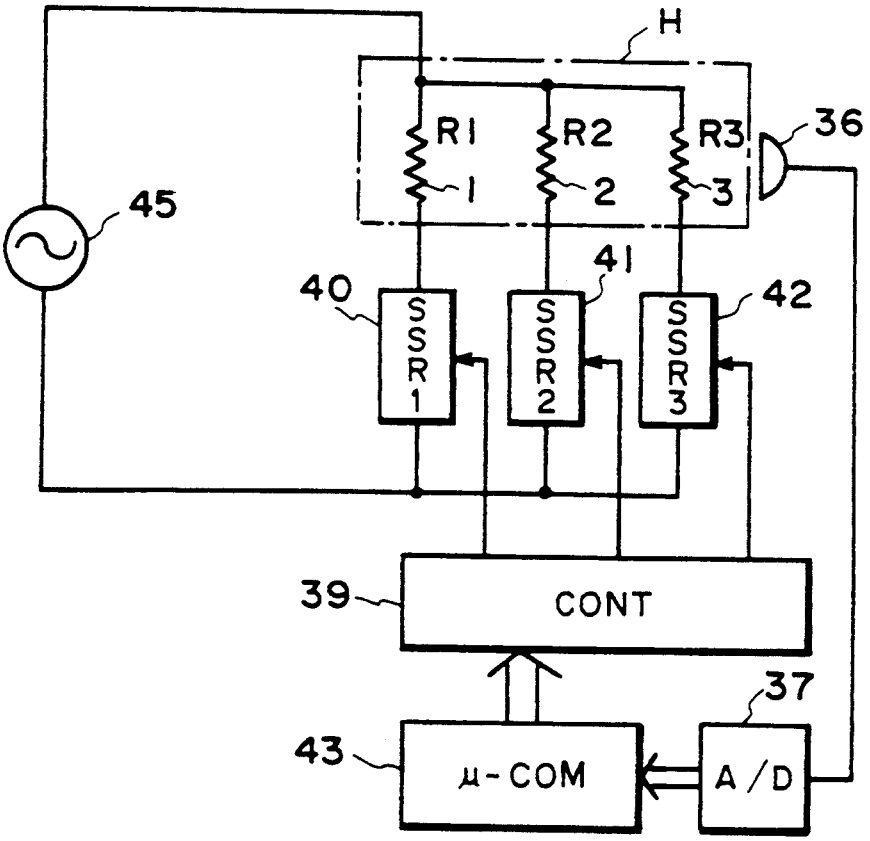
FIG. 16 is a block diagram of a temperature control system of a heater for an image fixing apparatus according to a first embodiment of the present invention.
Figure 17:
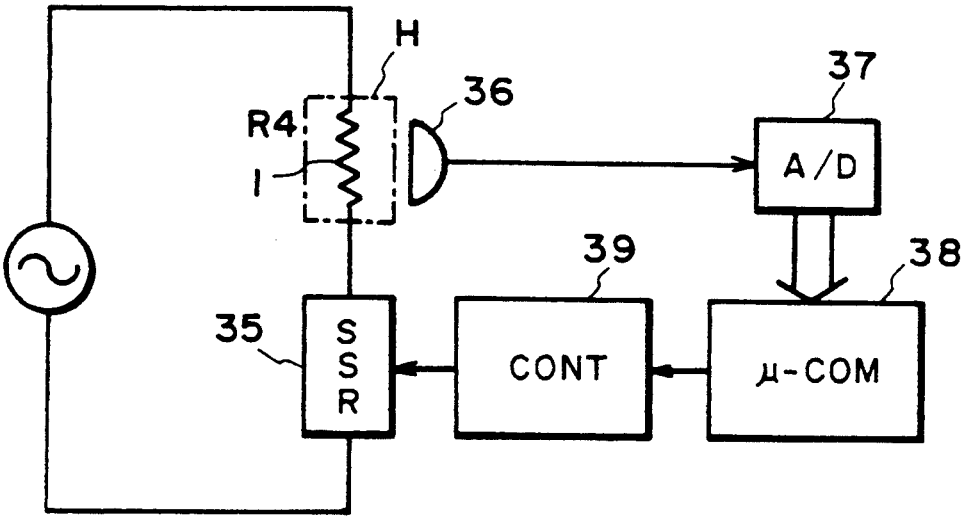
FIG. 17 PRIOR ART
FIG. 17 is a block diagram of a conventional temperature control apparatus.

Referring to FIG. 16, there is shown a temperature control device for the heater of this embodiment. The temperature control device of the heater of this embodiment is particularly suitable for controlling a heater having three resistors. The power supply to the resistors 1, 2 and 3 of the heater H from the utility electric power source 45 is controlled, using switching elements 40, 41 and 42 in the form of a TRIAC (triode AC switch). The temperature of the heater is detected by a thermister 36, and is fed to microcomputer 43 through an A/D converter 37. The microcomputer 43 carries out the processing for maintaning the heater temperature at a predetermined level, by supplying control signal to the control circuit 39. The control circuit 35 functions to effect on-off control for each switching element 40, 41 and 42, and is controlled by the microcomputer 43. The control circuit 39 comprises a plurality of triffering circuits for controlling the switching elements 40–42, respectively, and a zero-cross circuit for the wave form of the power source. In accordance with the control signal produced from the microcomputer 43, the trigger signals are produced to the switching elements upon the zero-cross of the wave form of the power source. The switching element becomesa conductive upon the supply of the trigger signal, and becomes opened at the zero-cross points of the wave for of the power source. Therefore, the load resistance of the heater to which the utility electric power is supplied, changes for each half wave of the period of the power source.

The description will be made as to a relationship between the resistances of the resistors 1–3, and the electric power supply to the heater, using an example.

The resistances R1, R2 and R3 of the resistors 1, 2 and 3, are assumed to be 1:2:4, namely, R1=R, R2=2R and R3=4R. Depending of the state of the switching elements SSR1, SSR2 and SSR3, the resultant resistance $R_{total}$ of the heater and the supplied electric power to the heater, are as shown in Table 1. The supplied powers are expressed as relative ones with the maximum being 1.

TABLE 1

| R1 SSR1 | R2 SSR2 | R3 SSR3 | Resultant $R_{total}$ | POWER |
|---|---|---|---|---|
| ON | ON | ON | 4/7 R | 1 |
| ON | ON | OFF | 4/6 R | 6/7 |
| ON | OFF | ON | 4/5 R | 5/7 |
| ON | OFF | OFF | 4/4 R | 4/7 |
| OFF | ON | ON | 4/3 R | 3/7 |
| OFF | ON | OFF | 4/2 R | 2/7 |
| OFF | OFF | ON | 4/1 R | 1/7 |
| OFF | OFF | OFF | ∞ | 0 |

Figure 18:
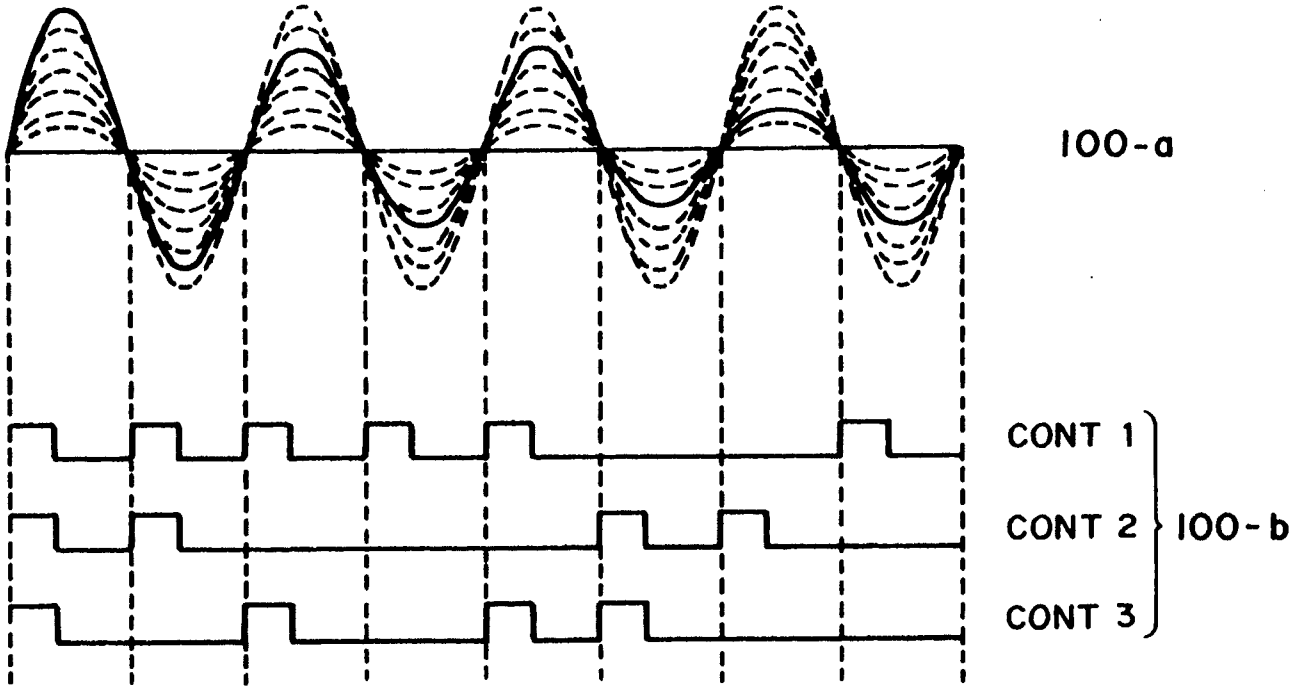
FIG. 18 shows a waveform used in the apparatus of FIG. 16.

As described in the foregoing, by controlling the actuation and deactuation of the switching elements 41, 42 and 43, the load current to the heater and the supplied electric power can be controlled with the unit of half wave of the period of the electric power source. The control state is shown in FIG. 18.

In this Figure, designated by reference 100-a is a wave form of the load current; 100-b (signal CONT1) is a trigger signal for the switching element (40) SSR1; CONT2 is a trigger signal for the switching element (41) SSR2; and CONT3 is a trigger signal for the switching element (42) SSR3.

Each switching element is closed only during the half of the period in which the trigger signal is at high-level. By the temperature control device for the heater shown in FIG. 16, the heater temperature is controlled in the following manner.

The temperature of the heater is detected by a thermister 36, and is converted to a digital signal. The digitalized temperature datum is supplied to the microcomputer 43, and is compared and processed with a predetermined temperature, so that a control signal is produced to the control circuit 39. More particularly, on the basis of the temperature difference between the detected temperature by the thermister 36 and the predetermined temperature, one is selected from 8 patterns in Table 1 in the manner that the resultant or combined resistance decreases with increase of the detected temperature of the thermister 36 relative to the predetermined temperature.

The present invention is applicable to the structure other than that having the resistors and the resistances described above. By increasing the number of resistors, a higher accuracy of temperature control is possible. In addition, by changing the structure of the resistance, the control sensitivity can be changed.

Figure 19:
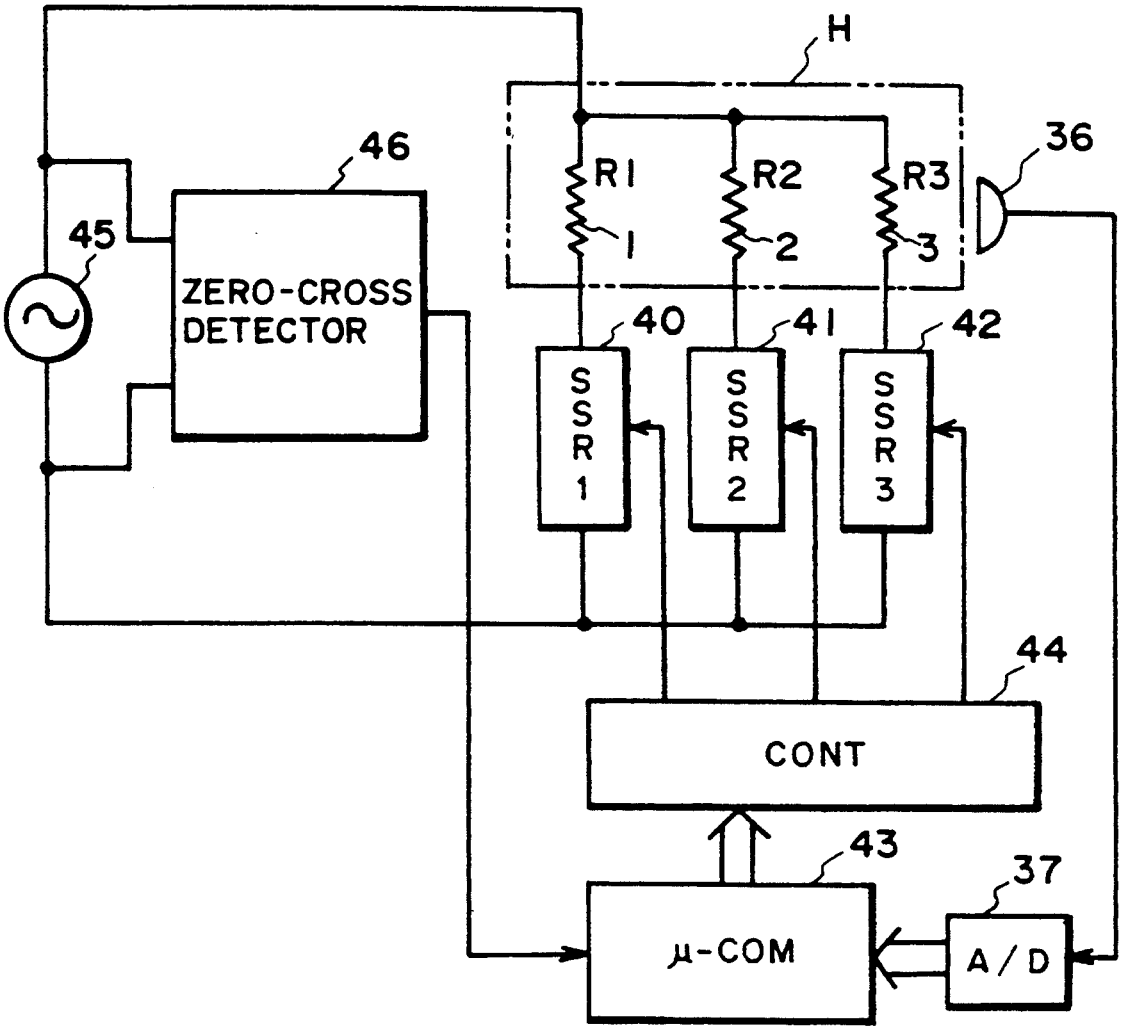
FIG. 19 is a block diagram of a temperature control system according to a second embodiment of the present invention.

Referring to FIG. 19, there is shown a temperature control device according to the second embodiment of the present invention.

The temperature control device according to the first embodiment has the zero-cross circuit for the waveform of the power supply in the control circuit 44. In this embodiment, however, there is provided a separate zero-cross circuit 46 for detecting the zero-cross points of the wave form, and the detected signal is fed to the microcomputer 43.

The control circuit 44 has a plurality of triggering circuits for controlling the switching elements 40–42, respectively, and produces trigger signals to the switching elements in the same phase as the control signal produced by the microcomputer 43. THe microcomputer 43 carried out the processing operation to determine the open and close timings of the switching elements in synchronism with the zero-cross pulses produced by the zero-cross detecting circuit 46. Then, it produces electric signals to the control circuit 44. The load resistance of the heater to which the electric power is supplied from the utility source 45, can be changed at given timings with the reference to the zero-cross points.

Figure 20:
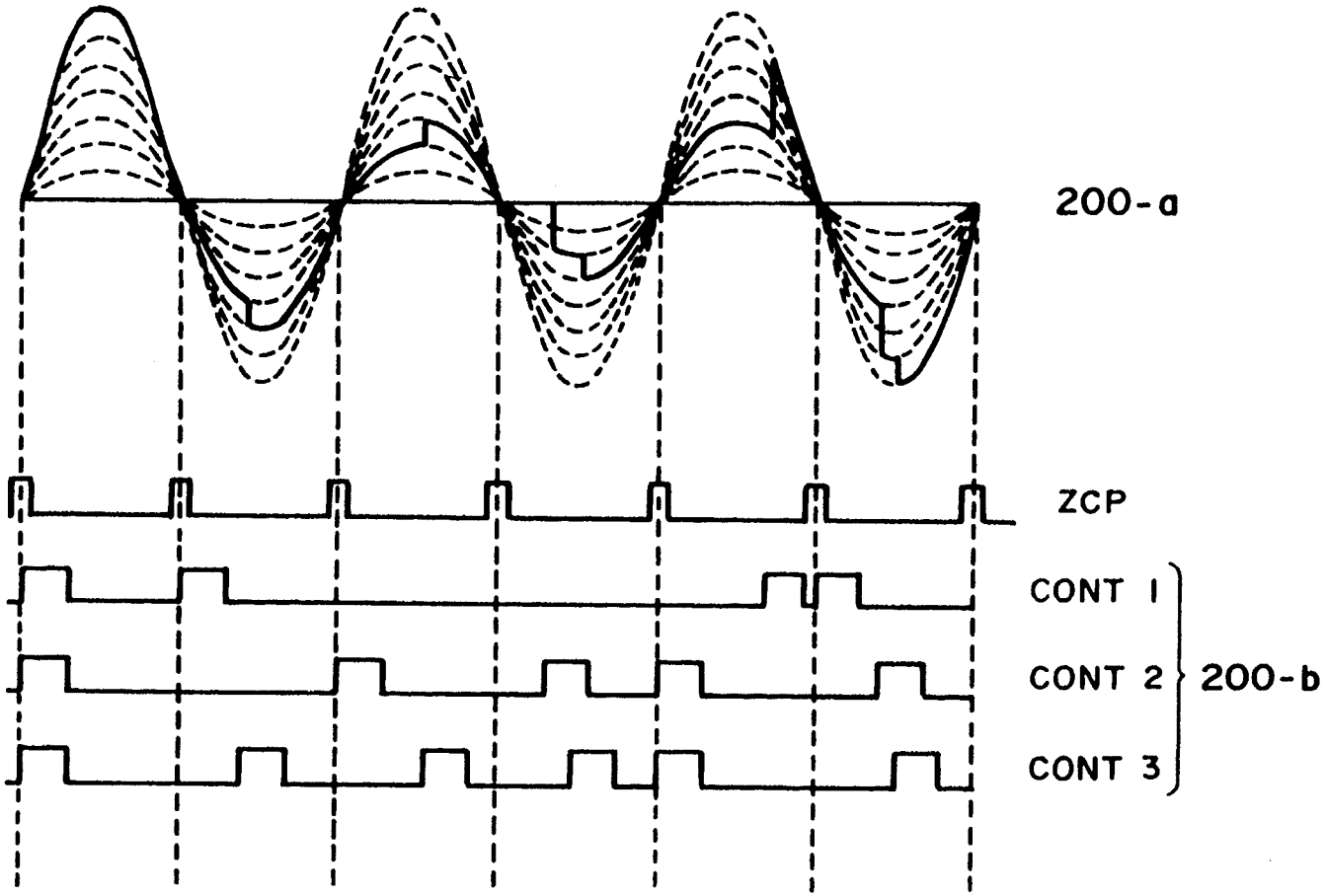
FIG. 20 shows a wave form used in the apparatus shown in FIG. 19.

FIG. 20 shows such an operation, in which designated by the reference 200-a is the load current waveform; ZCP is a zero-cross pulse having the wave form 200-b; CONT1 is a trigger signal for the switching element SSR1; CONT2 is a trigger signal for the switching circuit SSR2; and CONT3 is a trigger signal for the switching element SSR3.

On the basis of the signal ZCP, the trigger signals are produced at any timings, and therefore, the load current to the heater and the supplied power, can be controlled with high accuracy.

Figure 21:
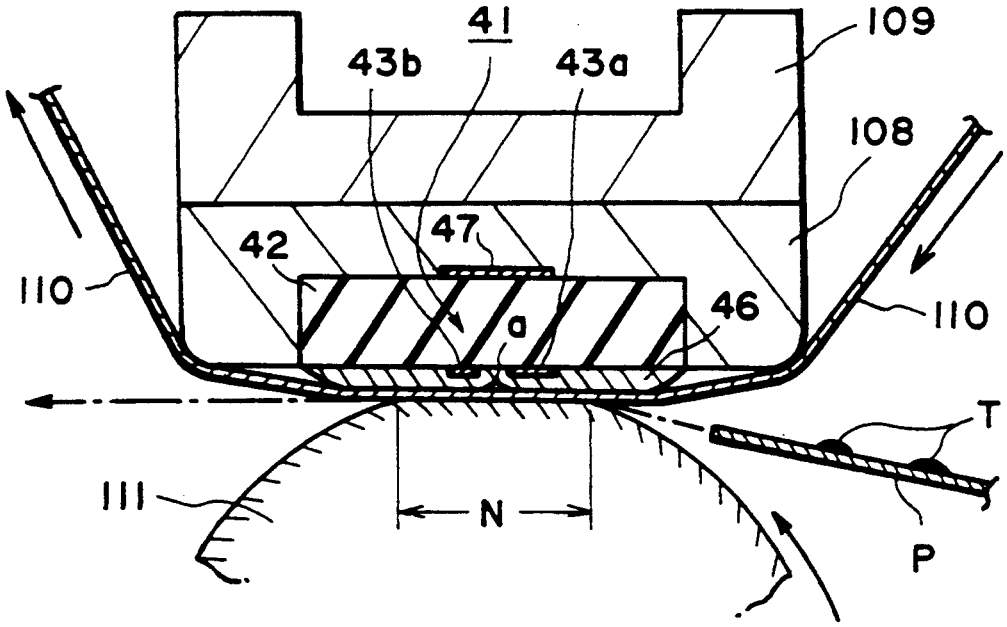
FIG. 21 is an enlarged sectional view of a portion of a heat fixing apparatus using a heater according to an embodiment of the present invention.
Figure 22:
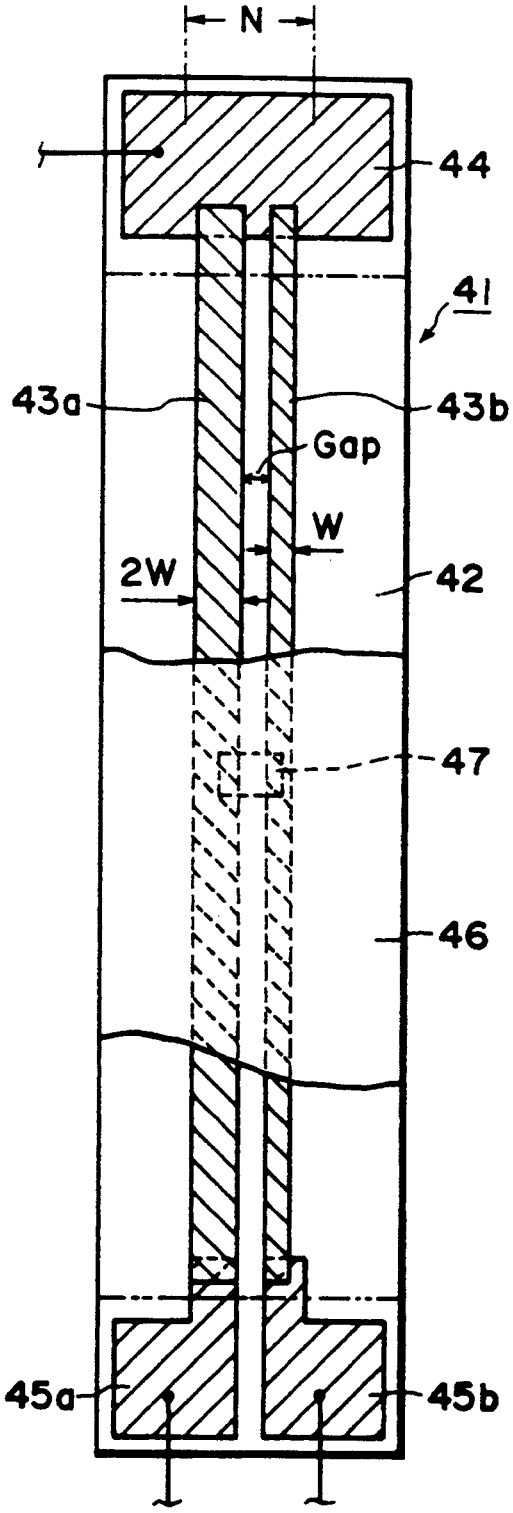
FIG. 22 is a top plan view of a heater according to a further embodiment of the present invention.
Figure 23:
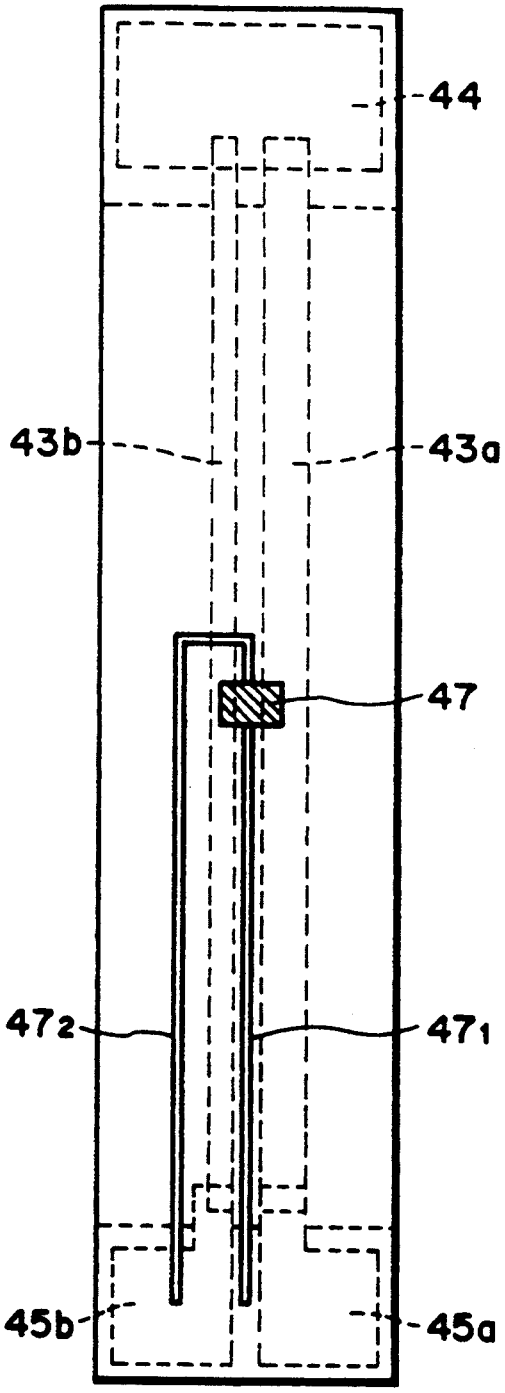
FIG. 23 is a rear side view of a heater of FIG. 22.

FIG. 21 is a partly enlarged sectional view of a heat fixing apparatus using a heater according to this embodiment. FIG. 22 is a top plan view, and FIG. 23 is a rear side view, of the heater. In the heater 4 of this embodiment, two heat generating resistors 43*a* and 43*b* having different resistances are juxtaposed on the surface of the base plate 42, so as to be extended along the length of the base plate substantially in the center of the width of the base plate.

At one side ends of the juxtaposed heat generating resistors 43*a* and 43*b*, a common electrode contact 44 for the resistors 43*a* and 43*b*, is formed on the base plate 42. At the other side ends, independent electrode contacts 45*a* and 45*b* are formed for the resistors 43*a* and 43*b* on the base plate 2 surface.

Designated by reference numerals 47(1) and 47(2) are connecting leads for a temperature detecting element 47 in the form of a thermister or the like on a backside of the base plate 2.

The power supply control to the two heat generating resistors 43*a* and 43*b* are effected by properly selecting the following four power supply patterns by the control circuit for each half wave of the AC source so that the temperature detecting element 43 detects the predetermined target temperature:

a. Both are energized:
b. Only one is energized:
c. Only the other is energized: and
d. Neither is energized.

More particularly, either of the following two methods is used.

(1) The temperature of the heater 41 is detected, and the detected temperature is compared and processed with the reference numeral data to control the temperature within a predetermined temperature range. There are provided a plurality of switching elements for controlling the power supplies to the resistors 43*a* and 43*b*. Also on the basis of the calculated control amount, the electric power supply to the resistors 43*a* and 43*b* are controlled for each half wave of the wave form of the power source.

(2) The temperature of the heater 41 is detected. The detected temperature is compared and processed with the reference temperature data to control the temperature within a predetermined temperature range. There are provided a plurality of switching elements for controlling the electric power supplies to the resistors 43*a* and 43*b*. There is also provided a zero-cross detecting means for the wave form of the power source. Also on the basis of the control amount calculated, the electric power supplies to the resistors 43*a* and 43*b* are controlled in the phase within a half wave of the wave form of the power source on the basis of the output of the zero-cross detecting means.

Using in either one of the methods (1) and (2), the heater can be provided which involves extremely small switching noise of the power source line and which has an extremely high temperature control property. In the Figure, designated by the reference 46 is an over coating layer of an electrical insulative property, made from glass or the like, as a heater surface protection layer for covering the surface having the heat generating resistor.

The base plate 42 is in the form of a ceramic plate or the like of $Al_2O_3$, AlN, SiC or the like having a width of 10 mm, a thickness of 1 mm and a length of 240 mm, for example.

The resistors 43*a* and 43*b* are pattern layers of Ag/Pd (silver-palladium alloy), $RuO_2$, $Ta_2N$ or the like provided by painting through a screen printing process or the like, having a thickness of 10 microns, width of 1 mm, for example.

The over coating layer 46 of the heater 41 is for sliding contact with a film. This surface is exposed externally, and the heater 41 is fixed and supported on a heater supporting member 109 through a heater holder H 103 of an insulating property.

Designated by a reference numeral 110 is a heat resistive film in the form of an endless belt or a long web made of polyimide or the like having a thickness of 40 microns, for example; and 111 is a rotatable pressing or back-up roller functioning as a pressing member for pressing the film to the heater 41.

The film 110 is rotated or traveled in close sliding contact with the surface of the heater 41 in a direction indicated by an arrow at a predetermined speed by the rotational force of the pressing roller 111 or by an unshown driving member.

The heater 41 is supplied with an electric voltage from a voltage source between the electrode contacts 44, 45*a* and 45 at the opposite ends of the heater is 43*a* and 43*b*, so that the heat generating resistors 43*a* and/or 43*b* generates the heat.

The temperature of the heater 41 is maintained at a predetermined temperature by detecting the temperature of the base plate on the back surface by the temperature detecting element 47, feeding the detected datum to the control circuit and controlling the electric power supply to the heat generating resistors 43*a* and 43*b*.

The temperature detecting element 47 of the heater 41 is disposed on a fixing surface exhibiting a highest thermal responsivity, that is, on the back side of the base plate at a position corresponding to the heat generating resistors 43*a* and 43*b* (the position on the back side of the base plate right below the heat generating resistor 3).

Under the state that the temperature of the heater 41 has been increased to the predetermined level by the electric power supply to the heat generating resistors 43*a* and 43*b* of the heater 1 and that the film 110 is moving, the recording material P (the member to be heated) is introduced into a fixing nip N formed between the film 110 and the back-up roller 110 with the unfixed toner image bearing side contacted to the film 110. The recording material P is close contact with the surface of the film 110 and passes through the fixing nip N with the film 110. During the moving process, the thermal energy is supplied to the recording material P from the heater 41 to the film 110, so that the unfixed toner image t on the recording material P is heated and fused and fixed.

Figure 42:
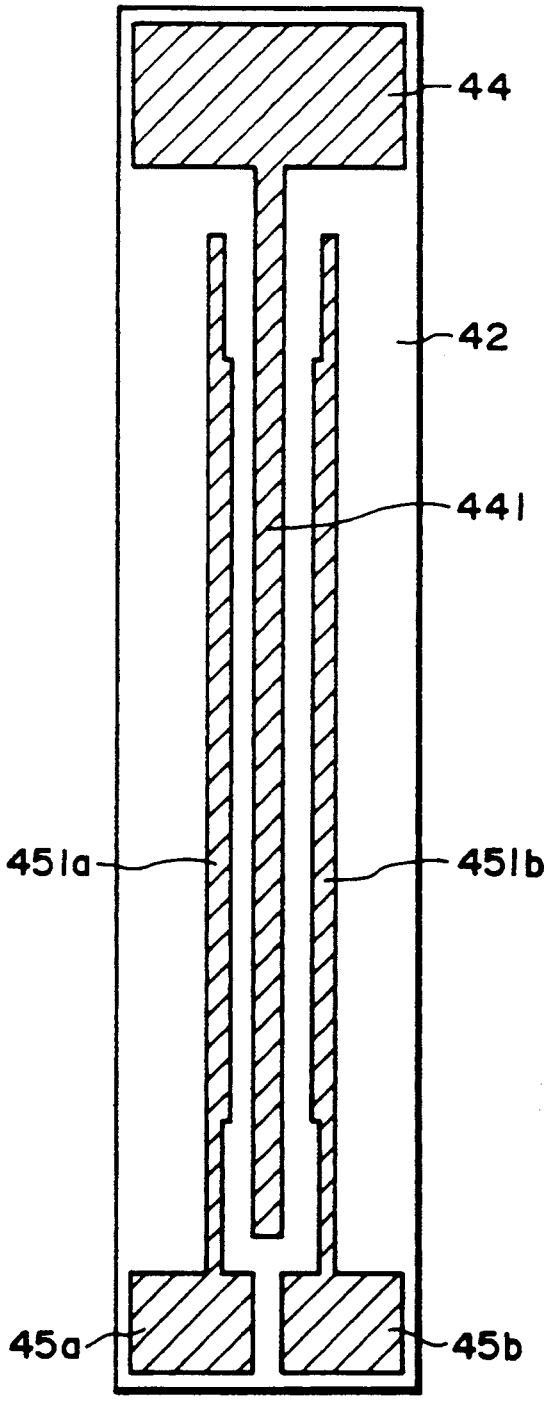
FIGS. 42, 43 and 46 are top plan views of electrode patterns of heaters according to further embodiments of the present invention.

FIG. 42 is a top plan view of a heater according to a further embodiment of the present invention. In this embodiment, the heater has three resistors 43*a*, 43*b* and 43*c*, an AC voltage source 112 and a power supply control circuit 113. In the image heat fixing apparatus, the toner images are fixed on the recording material P by pressing, heating and fusing the toner image therefor, the fixing property is closely related to the pressure and the heater temperature.

In view of this, the resistor 43 of the heater 41 is preferably at a position corresponding to a position where the pressure is highest, that is, at the center of the width of the fixing nip formed between the heater 41 and the pressing roller 111 with the film 110 sandwiched therebetween, from the standpoint of the fixing property and the thermal efficiency of the heater.

However, when the nip is formed with a heater having a plurality of resistors, referring to a heater 41 having two resistors shown in FIGS. 21, 22 and 23, the resistor formed surface of the base plate 41 having the resistors 43*a* and 43*b* is coated with an over coating layer 46 of glass or the like. Therefore, as shown in FIG. 21 which is a side sectional view, the portion of the over coating layer between the two resistors 3*a* and 3*b*, are slightly recessed, and the recess a corresponds to the center of the width of the fixing nip N.

The electric power supply to the two heat generating resistors 43*a* and 43*b* is selectively effected such that the thermister 47 (temperature detecting element) on the back side of the heater detects the predetermined set temperature. As described hereinbefore, the four patterns, namely, the power supply to the both heaters 43*a* and 43*b*, power supply to only one of them, the power supply only to the other and the power supply to both of them, and therefore, the highest pressure portion in the fixing nip N is not always the heat generating portion at any instances.

As an example of the electric power supply pattern, the electric power supply to one of the heat generating resistors continues during sheet passage. In this case, even if the temperature detected by the temperature detecting element 47 converges to the set temperature, there is a temperature gradient in the direction of the thickness of the heater 1.

In this state, the portion of the nip corresponding to the energized heater, mainly rules the fixing action. If the situation changes suddenly from this state to the state in which the other heat generating resistor is energized, then the ruling portion of the nip also moves. During this, the recording material P passing through the fixing nip N may be subjected to improper image fixing due to the change of the temperature gradient in the width of the heater 41.

Figure 24:
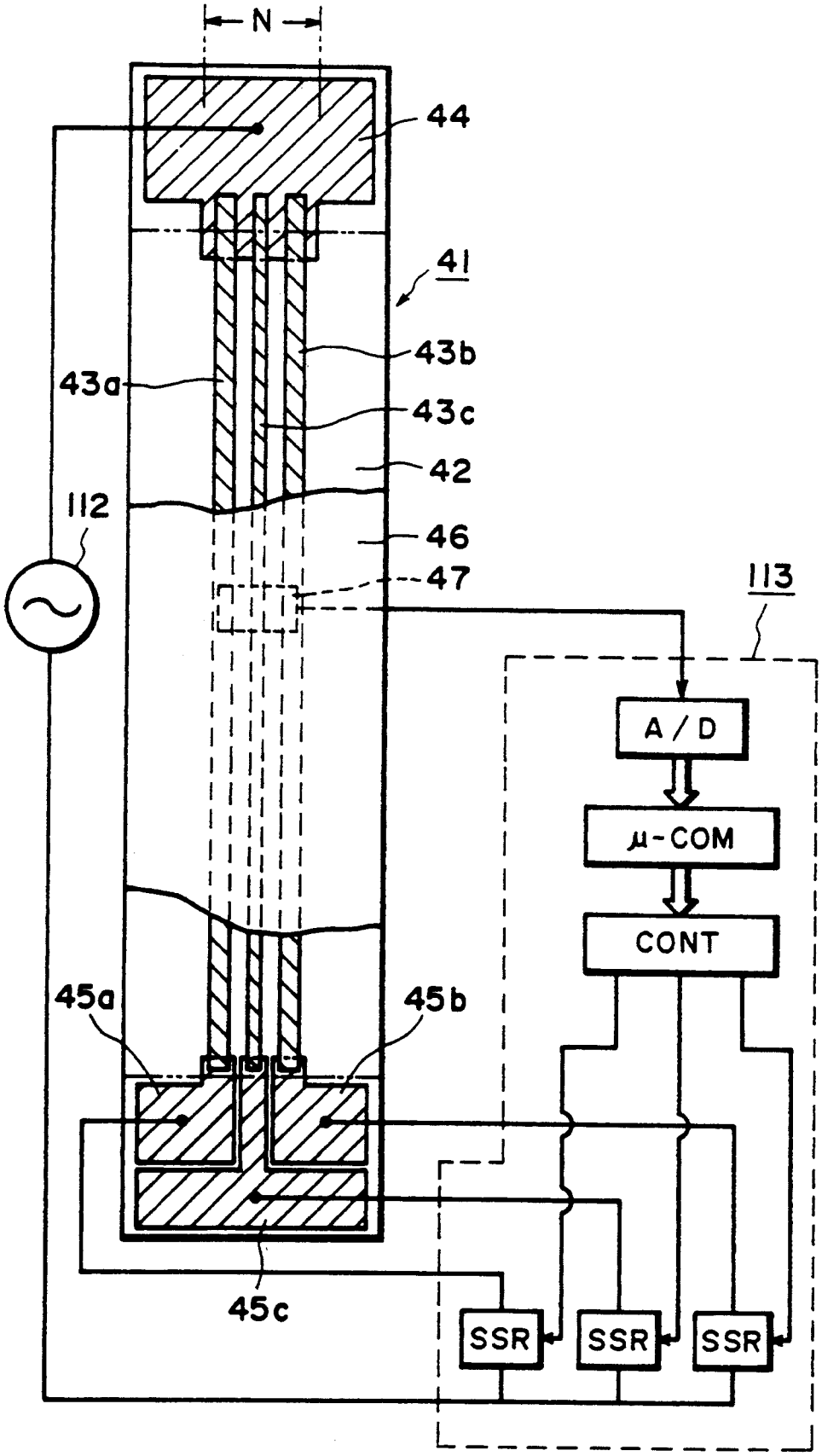
FIG. 24 is a top plan view of a circuit diagram of a heating apparatus according to a further embodiment of the present invention.

This applies also to the case in which three or more heaters are used in FIG. 24.

The description will be made as to an embodiment which is suitably usable with an image fixing apparatus, wherein the improper image fixing does not occur.

Figure 25:
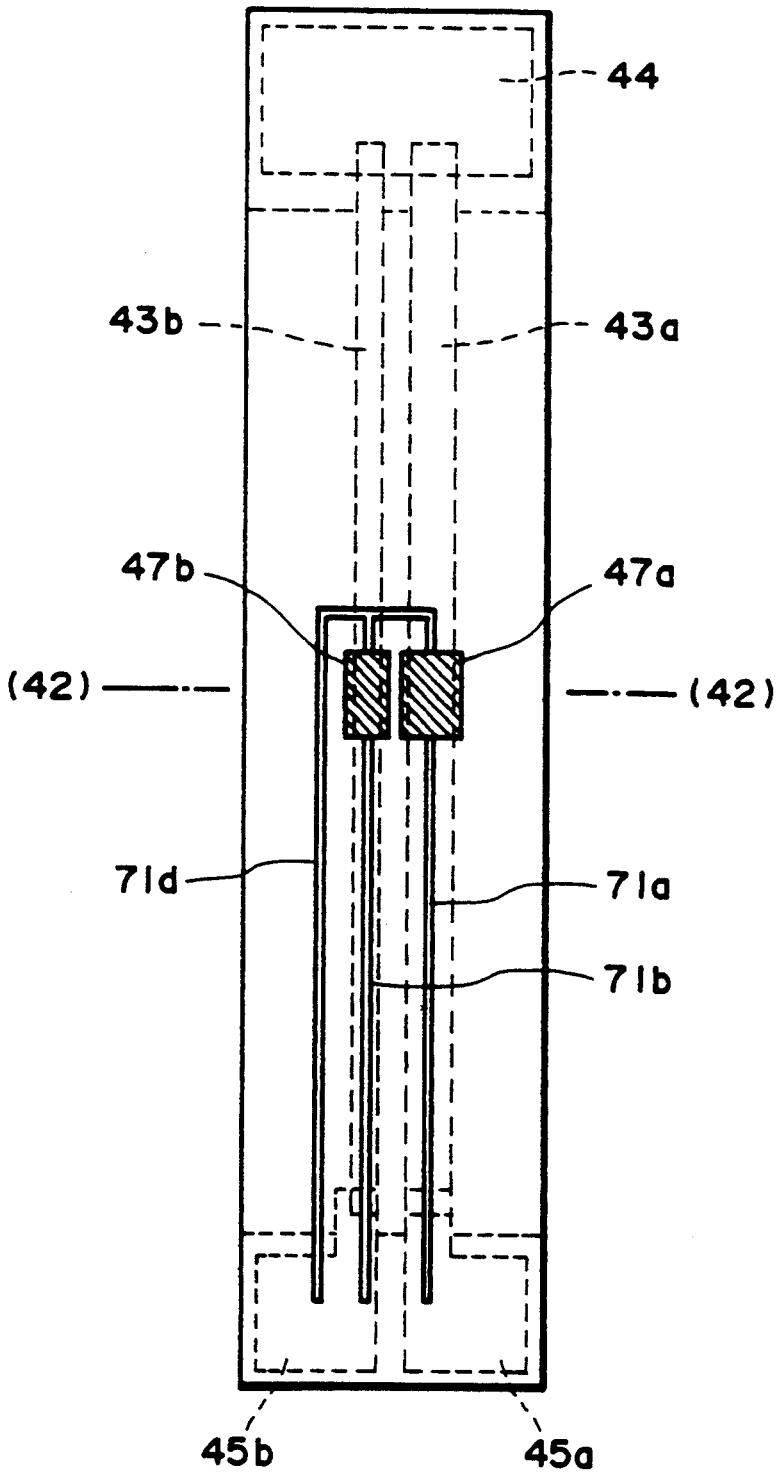
FIG. 25 is a rear view of a heater according to a further embodiment of the present invention.
Figure 26:
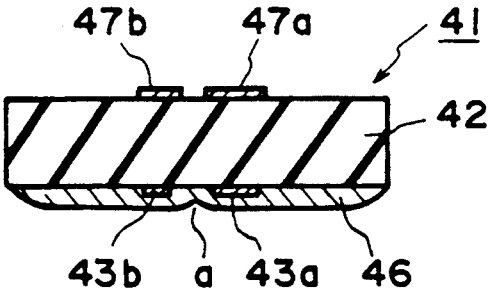
FIG. 26 is a sectional view taken along a line (2)—(2) of FIG. 25.
Figure 27:
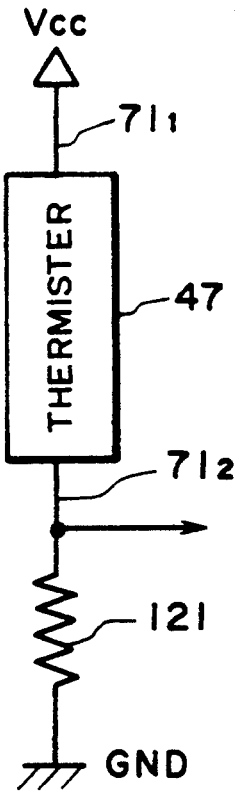
FIG. 27 illustrate temperature detecting operation.

Referring to FIG. 25, there is shown a heater according to this embodiment in a top plan view. FIG. 26 is a sectional view taken along a line (42)—(42) in FIG. 26, and FIG. 27 is a circuit diagram. The temperature detecting elements 47*a* and 47*b* are bonded or threaded on the back side surface of the base plate at the above-described position in the state of close contact thereto. The temperature detecting elements 47*a* and 47*b* are of the type using thermister or the like responsive to the temperature by change of the resistance.

Designated by the references 71*a*, 71*b* and 71*d* are leads connected to the temperature detecting elements 47*a* and 47*b*. Among them, the leads 71*a* and 71*b* are individual leads connected to the temperature detecting elements 47*a* and 47*b*, and 71*d* is a common leads for the other contacts.

As shown in FIG. 27, an end 71 (1) of the lead for the temperature detecting element 47 is connected to a DC power source Vcc, and the other end 71 (2) is connected to the ground (GND) through a fixed resistor 121 having a small temperature coefficient disposed at a position away from the heater. Then, the voltage between the temperature detecting element 47 and the fixed resistor 121, can be detected as a temperature of the temperature detecting element on the basis of a relation between the detected temperature and the resistance.

Therefore, among the leads 71*a*, 71*b* and 71*d* for the two temperature detecting elements 47*a* and 47*b* on the backside of the heater base in the heater 41 of FIG. 25, the common lead 71*d* is used for connection with the DC source (Vcc), and the individual leads 71*a* and 71*b* are connected to the ground (GND) through the individual fixed resistors 121. By doing so, the temperatures in the neighborhood of the resistors 43*a* and 43*b* of the heater 41 can be independently detected by the temperature detecting elements 47*a* and 47*b*.

As for the power supply control to the resistors 43*a* and 43*b*, the four supply patterns (both, one, the other and neither) can be selectively used for each half period of the alternating power source so that the temperature detecting element detects the set temperature.

The average of the detected temperatures of the two temperature detecting elements 17*a* and 17*b* is taken as a heater temperature, and is compared with a set temperature. On the basis of that, the four power supply patterns are selected. In addition, the difference of the temperatures detected by the two temperature detecting elements 47*a* and 47*b* is taken as a temperature gradient in the direction of the width of the heater. When the temperature gradient is 2° C. or higher, for example, the next half wave supply is effected to the low temperature resistor 7*a* or 7*b*, by correcting the power supply pattern obtained from the average temperature and by using the corrected pattern.

By doing so, it can be avoided that the temperature gradient in the heater width direction changes significantly, and therefore, in the case of the image heat fixing apparatus, the non-uniform image fixing or the like due to the temperature gradient can be prevented.

Figure 28:
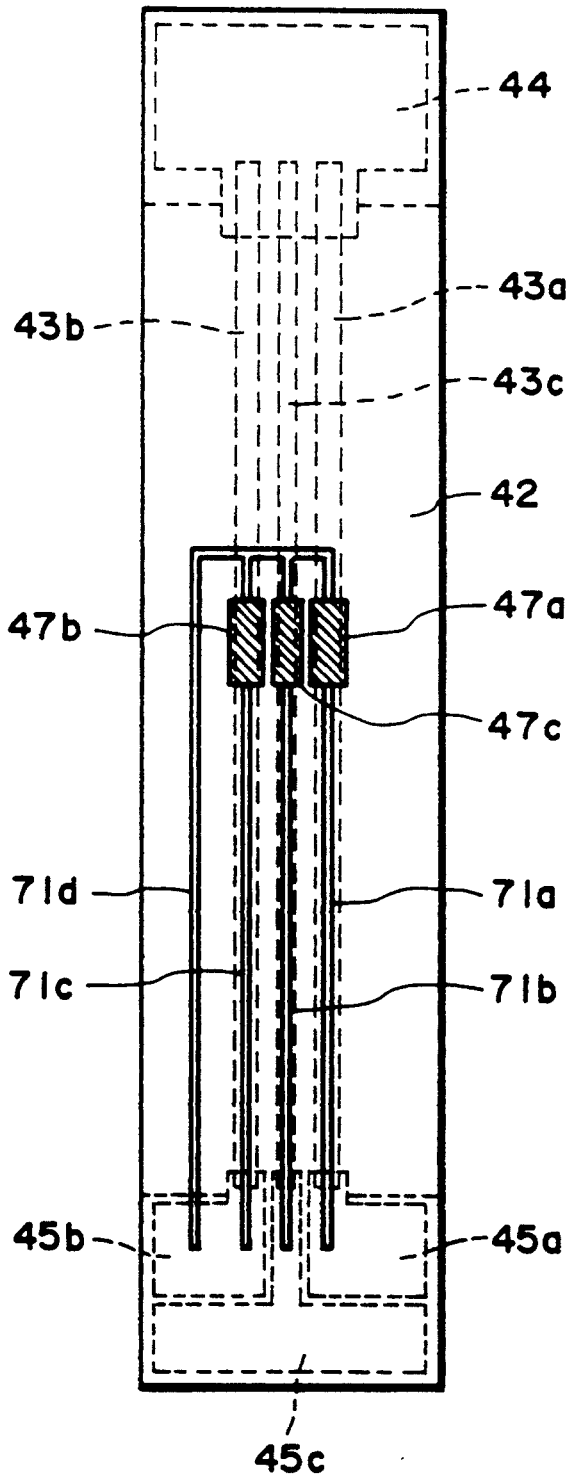
FIG. 28 is a rear view of a heater according to a further embodiment of the present invention.

FIG. 28 is a rear view of a heater, in which three, in total, temperature detecting elements 47*a*, 47*b* and 47*c* for detecting the heater temperature are disposed on the backside of the base plate at such a position as corresponds to the position of formations of the resistors 43*a*, 43*b* and 43*c* on the front side of the base plate 42. The electric power supply control to the heater and the heater temperature control, are the same as has been described with FIG. 25.

Figure 29:
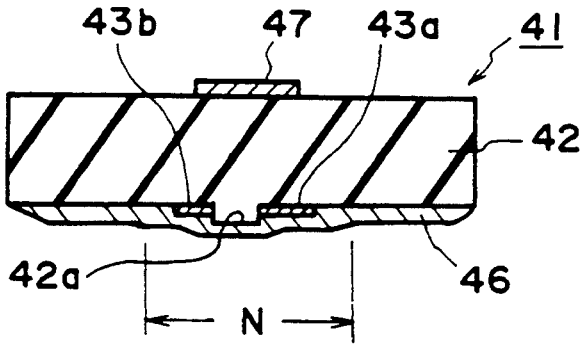
FIGS. 29, 30 and 31 are sectional views of heaters according to further embodiments.

FIG. 29 is a sectional view according to a further embodiment. In this embodiment, the central portion, in the direction of the width, of the front surface of the base plate 42 is in the form of a rib 42*a* extending along the longitudinal direction of the base plate. The two resistors 43*a* and 43*b* are formed at the respective sides of the rib. The surface is coated with an electrically insulative over coating layer 46.

The rib 42a has a width of 0.3–0.5 mm and a height of approx. 10–20 microns, the thickness of the resistors 43a and 43b is approx. 10 microns.

By the provision of the rib or projection 2a, the portion between the two resistors 43a and 43b in the middle of the width of the heater corresponding to the substantial center of the width of the fixing nip N, is projected.

Therefore, the central portion of the fixing nip corresponding to the projection of the heater 41 in the direction of the width thereof, is a center of the nip where the pressure is the highest, so that the thermal efficiency and the fixing property are improved. In addition, it can be avoided that the recording material (the member to be heated) is prevented from creaseing or jamming.

Figure 30:
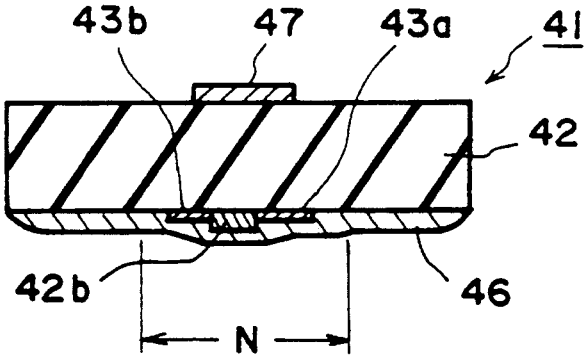

FIG. 30 shows a further embodiment, in which the projected portion of the heater 41 is in the form of a thermally conductive projection 42b having an electrically insulative property. The same advantageous effects as in the heater 41 of FIG. 29, are provided. In addition, by making the thermal conductivity of the projected portion 42b higher than that of the base plate 42, the thermal transfer efficiency at the center of the width of the fixing nip N is increased.

For example, the base plate 42 is made of alumina or the like, and the projected portion 42b is made of aluminum nitride or the like having a thermal conductivity of the alumina, by which the heat generated by the resistors 43a and 43b are efficiently transferred to the central portion of the fixing nip N (in the direction of the width thereof) through a projection 2b of the thermally conductive material, and therefore, the heat is more efficiently used for fixing the toner image.

Figure 31:
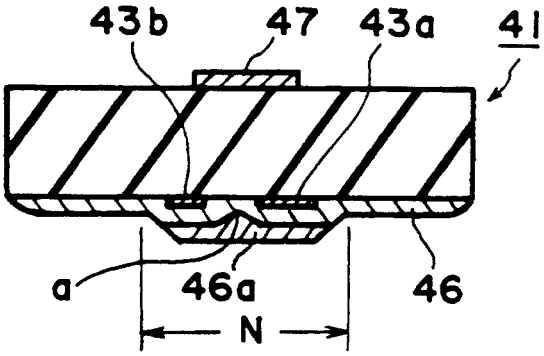

FIG. 31 shows a further embodiment, in which an additional over coating layer 46b is formed on the electrically insulative over coating layer 46, so that the height of the surface of the over coating layer between the two heat generating resistors 43a and 43b is made larger than the other portion.

The same advantageous effects as by FIG. 29, can be provided. The heater of this embodiment is inferior to the heaters of FIGS. 29 and 30 from the standpoint of thermal efficiency, but the structure is simpler than those of FIGS. 29 and 30, with the advantage of no necessity for special processes.

Figure 32:
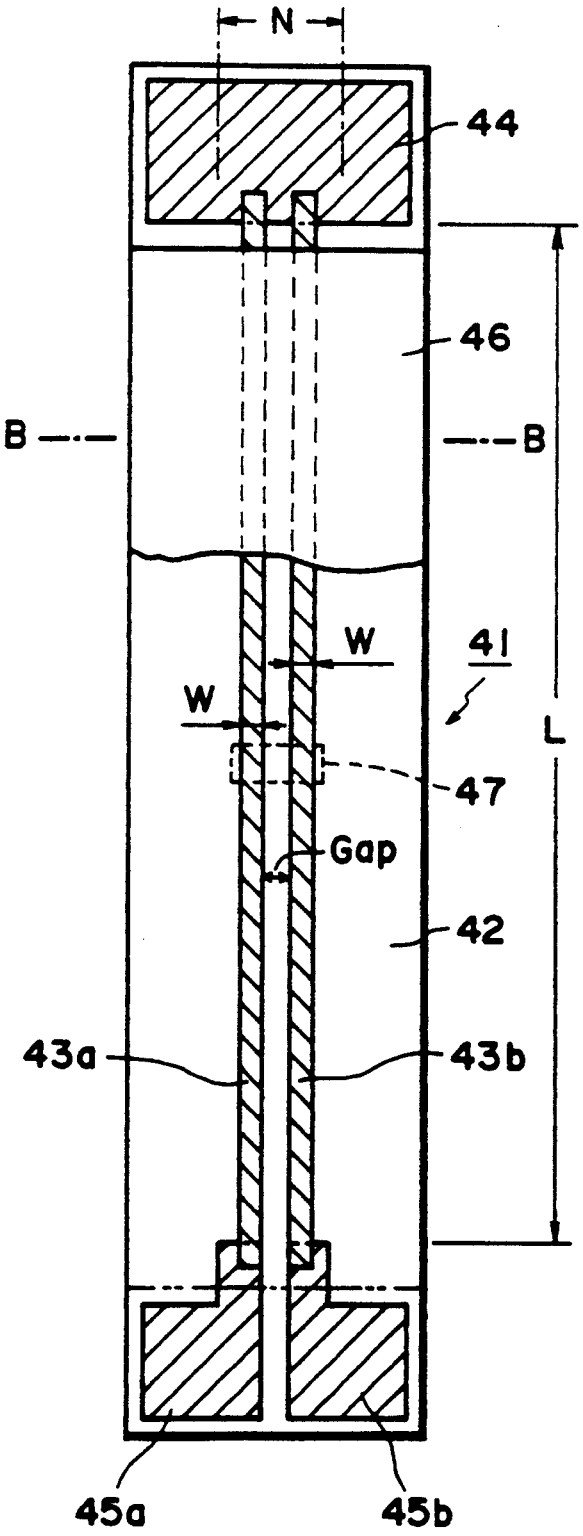
FIG. 32 is a sectional view of a heater according to a further embodiment of the present invention.
Figure 33:
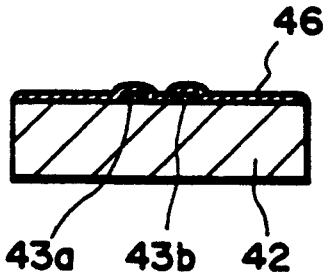
FIG. 33 is a sectional view of an apparatus shown in FIG. 32.

FIG. 32 is a top plan view of a heater 41 according to a further embodiment of the present invention, and FIG. 33 is a sectional view taken along a line b—b. In this embodiment, the common contacts 44 and two individual contacts 45a and 45b are formed on the surfaces at the longitudinally opposite ends of the base plate 42, by printing silver paste, and the printed pattern is partly sintered.

One 43a of the heat generating resistors is printed on the surface of the base plate between the common contact 44 and one of the individual contacts 45a with electric connection therewith. The material has a resistivity $\rho$ and is Ag/Pd and has a width of W and a thickness of t so as to provide a resistance R relative to the effective heater length. It is in the form of an elongated stripe. The relation between the resistance R and the dimensions is:

$$R=\rho \cdot L/(W \cdot t)$$

Then, the other resistor 43b is printed on the surface of the base plate between the common contact 44 and the individual contact 45b in parallel with the resistor 43a. The material has a resistivity of $2\rho$ and is made of Ag/Pd and has a width W and a thickness t in the form of an elongated stripe. The space between the resistors 43a and 43b is large enough to avoid short-circuit $G_{ap}$. THe printing block is recessed to avoid destroying the previously formed resistor 43a.

Subsequently, an overcoating layer (low fusing point glass) 46 is formed on the base plate surface having the resistors 43a and 43b except for the electrode contacts 44, 45a and 45b. Thereafter, the plate is completely sintered as a whole. A temperature detecting element 47 is formed on a backside of a base plate 42.

In this embodiment, one of the resistors has a resistance which is twice the other, but the width W of the resistors 43a and 43b are the same. If two resistors having respectively a volume resistivity, and twice the volume resistivity, are formed through one printing step using resistor material (paste) having the same resistivity, the widths of one of them is twice the other (2W, W), as in the conventional structure, as shown in FIG. 22.

In heater 1 of this embodiment, the common contact 44 of two resistors 43a and 43b is connected to one contact of the power source, and the individual contacts 45a and 45b of the resistors 43a and 43b are connected to the other contact of the voltage source through switches. By on-off control of the switches, the load resistance of the heater is changed to control the heat generation amount.

Thus, by using the resistance materials having different resistivities, the increase of a width of the resistors 43a and 43b can be suppressed. Thus, the heat generating width of the heater can be reduced with the advantage of high thermal responsivity and the stabilized temperature distribution in the heat generating area. This improves the fixing performance.

In other words, the materials of the resistors are different in the volume resistivities, and the resistors are formed through plural printing steps, and therefore, a heater having a small width of the resistors can be provided with the desired resistance value. Therefore, the width in which the resistor exists, can be suppressed, and all the resistors are provided in a region (fixing nip N) which is pressed by the back-up roller. This improves the stability of the fixing performance.

When the materials of the resistors are Ag/Pd, the sheet resistance values are different in the range of 10–40 mΩ/□, depending on the contents of the components and or the sintering conditions or the like.

The following is examples of thick resistance materials:

$RuO_1$ (3.5E–5 Ω.cm),
$IrO_2$ (4.9E–5 Ω.cm),
$LaRuO_3$ (4.5E–3 Ω.cm),
$CaRuO_3$ (3.7E–2 Ω.cm),
$Pb_2Ru_2O_6$ (2.0E–2 Ω.cm),
$LaB_6$ (17.4E–6 Ω.cm),
$PrB_6$ (19.5E–6 Ω.cm), and
$NdB_6$ (20.0E–6 Ω.cm).

The thick resistance material (paste) may be different resistivity, depending on the contents of the conductive particles and glass frit.

Figure 34:
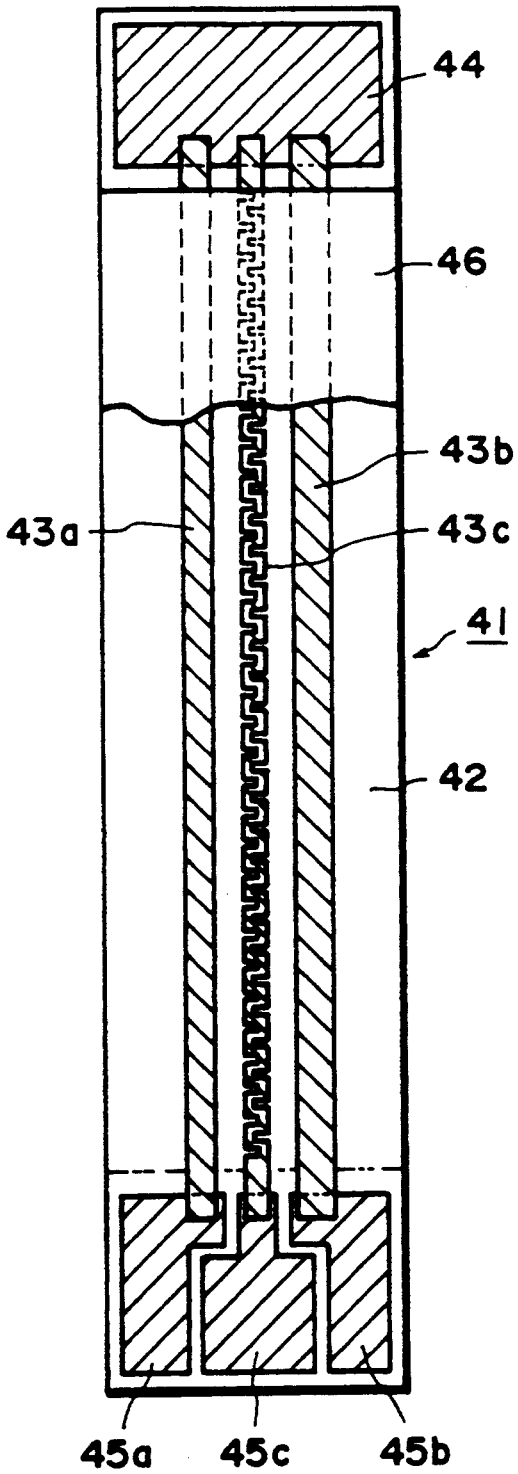
FIGS. 34 and 35 are top plan views of a heaters according to further embodiments of the present invention.

FIG. 34 is a top plan view of a heater according to a further embodiment of the present invention. In the heater 41 of this embodiment, three parallel heat generating resistors 43a and 43b and 43c are printed along a length of the base plate at the center in the direction of the width thereof similarly in the conventional heater. One set of ends of the three resistors 43*a*, 43*c* and 43*b*, are connected to a common contacts 44, and the other set of ends are connected to individual contacts 45*a*, 45*c* and 45*b*.

The common contact 44 is connected with one contact of the power source, and the individual contacts 45*a*, 45*c* and 45*b* are connected to the other contact of the voltage source through switches. By selective on-off control of the switches, the load resistance of the heater is changed to control the heat generating amount.

In this embodiment, the central one 43*c* of the three heat generating resistors, is in the form of wave, thus increasing the length thereof, and therefore, the resistance value of the resistor 43*c*.

Generally, the amount of the heat generation of the resistor is expressed as W=V2/R, and therefore, the heat generation amount decreases with increase of the resistance R. Therefore, in order to effect a precise temperature control, a resistor having a large resistance is desirably used. In order to increase the resistance in the limited size of the base plate, the width thereof may be reduced. However, in this case, the reliability decreases because the risk of break increases. The resistor in this embodiment is formed with such a wave pattern without deteriorating the reliability. Therefore, the precise and reliable temperature control is accomplished, and therefore, the image fixing performance is increased.

In other words, by employing a wave form as the pattern of the resistor, the resistance per unit length in the effective heater area can be increased. This is because the highly precise control is permitted because $$\text{Power} = V2/R.$$

Figure 35:
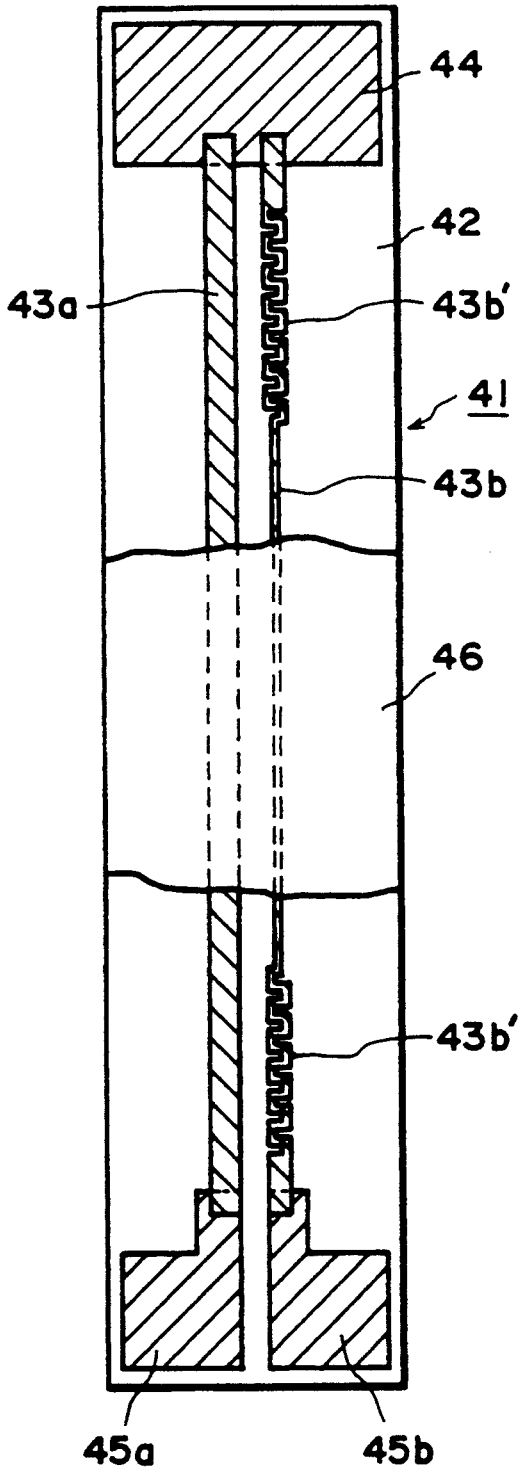

In FIG. 35, a heater 41 is shown in which two parallel heat generating resistors 43*a* and 43*b* are extended, and wherein end portions 43*b'* and 43*b'* of one of the resistors 43*b* is corrugated.

As described hereinbefore, a high resistance value is desirable for a precise temperature control. On the other hand, at the end portions of the heater, the temperature is lower as compared with the central portion by end effect. By the use of the corrugated form at the end portions, the area of the resistor is larger at each of the end portions, and therefore, the heat generation in the end portions increase to compensate for the end effects to remove the temperature difference between the end portions and the central portion in the length of the heater. Thus, the temperature distribution in the length of the heater becomes uniform, so that the image fixing performance is improved.

Figure 36:
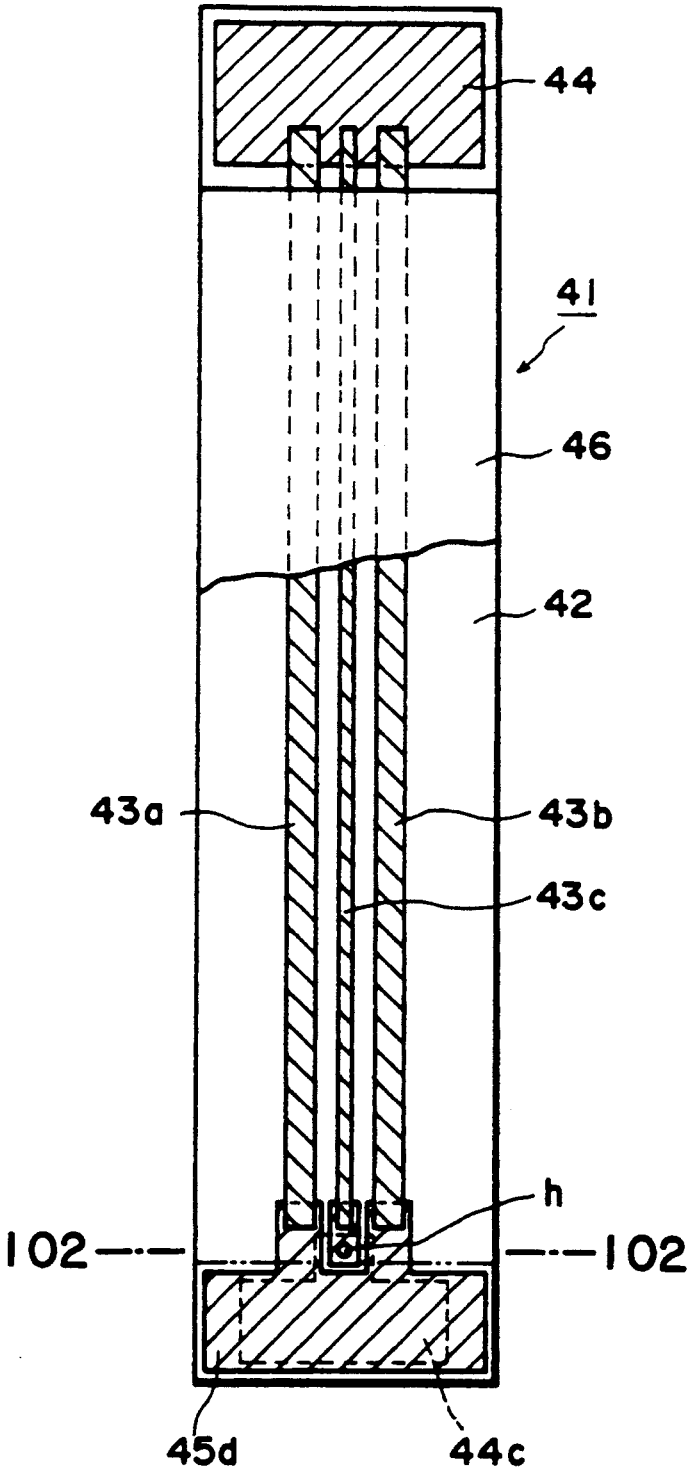
FIG. 36 is a top plan view of a heater according to a further embodiment of the present invention.
Figure 37:
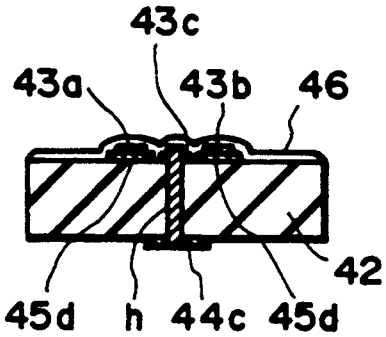
FIG. 37 is a sectional view of the device of FIG. 36.

In a heater 41 shown in FIGS. 36 and 37, three parallel heat generating resistors 43*a*, 43*c* and 43*b* are extended, and end portions of the resistors 43*a*, 43*c* and 43*b* are contacted to a common electrode contact 44. The other ends of the outside ones 43*a* and 43*b* of the resistors, is connected to a common contact 45*d*. The center resistor 43*c* is connected to an individual electrode contact 44*c* on the back side of the base plate 44 through a through hole h.

In this manner, the through hole of the base plate extends to establish electric connection with the independent electrode contact, and the electric contact is provided on the back side of the base plate (not having the resistors), so that the usable area for the electrode contacts can be expanded. Thus, the reliable heater is accomplished without increasing the size of the base plate.

Among the three parallel resistors 43*a*, 43*c* and 43*b*, the outside resistors 43*a* and 43*b* are connected at one ends thereof to the common contacts 44 and 45*d*, and therefore, the outside resistors 43*a* and 43*b* are simultaneously energized, while the center resistor 43*c* is independently energized. By doing so, the both sides of the width of the heater are heated simultaneously, and therefore, the temperature distribution in the direction of the width of the heater becomes uniform.

The common contacts 44 of the three resistors 43*a*, 43*c* and 43*b* is connected with one contact of the voltage source, and the common contact 45*d* and the independent contact 45*c* of the resistor 43*c* at the other end, are connected through respective switches with the other contact of the voltage source. By selective on-off control of the switches, the load resistance of the heater can be changed to control the amount of heat generation.

At this time, the two outside resistors 43*a* and 43*b* are simultaneously energized, so that the number of switches can be reduced, and the non-uniformity of the temperature distribution can be avoided. Therefore, the improper image fixing due to the non-uniform temperature distribution can be avoided, and therefore, the fixing performance is improved.

Figure 38:
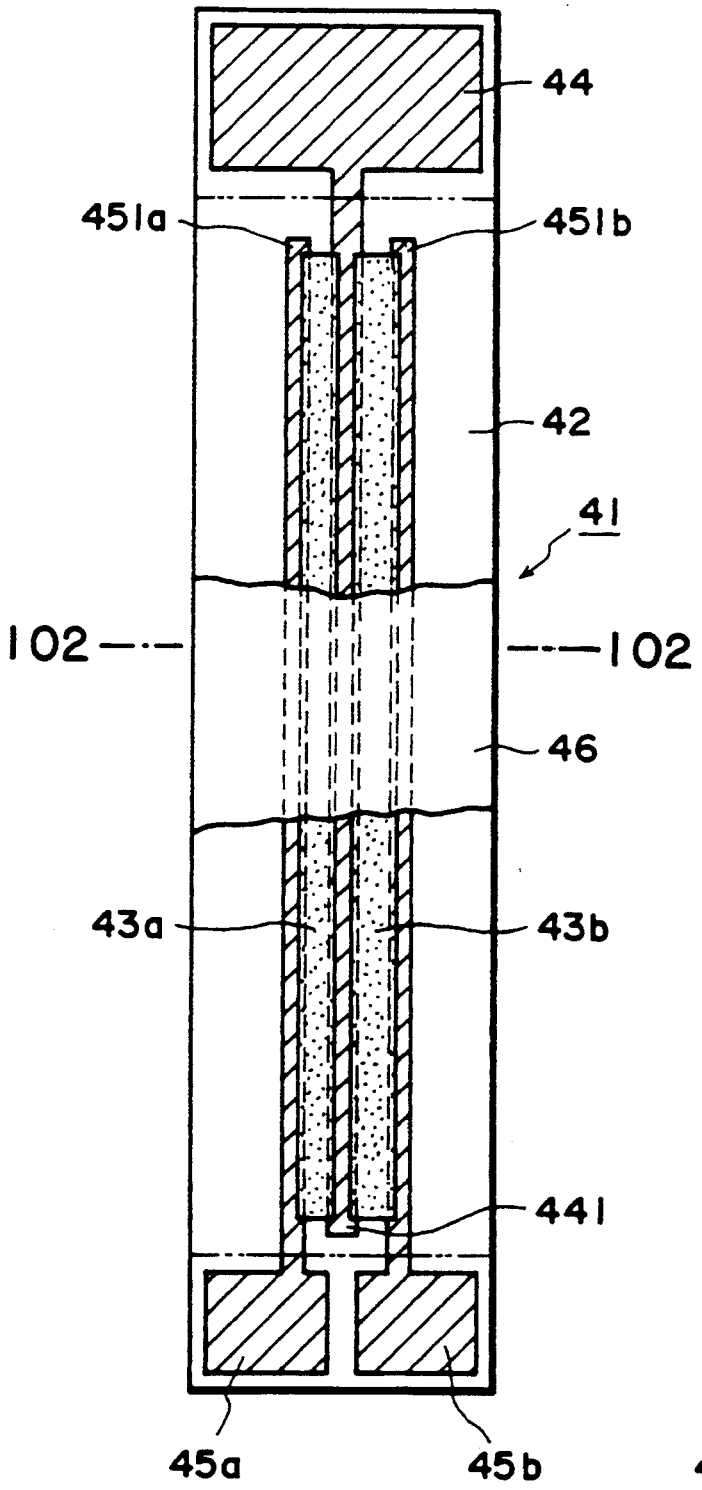
FIG. 38 is a top plan view of a heater according to a further embodiment of the present invention.
Figure 39:
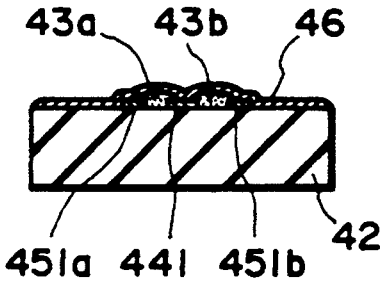
FIG. 39 is a sectional view of the device of FIG. 38.

FIGS. 38 and 39 show a further embodiment. A common electrode 44 at an end of the surface of the base plate 42 is in the form of a pattern having an elongated extension extending toward the other end of the base plate in the central portion in the direction of the width. The two individual electrodes 45*a* and 45*b* adjacent the other end of the base plat 42 are in the form of a pattern having elongated extensions 451*a* and 451*b* extending toward the other side in parallel with the extended electrode 441 with predetermined spaces therebetween at the both sides of the extended electrode 441. The electrodes 44, 45*a* and 45*b* and the extended electrodes 441, 451*a* and 451*b* are formed by printing silver paste on the surface of the base plate 42.

Bridging between the extended electrodes 441 and 451*a* and between the extended electrodes 441 and 451*b*, heat generating resistors 43*a* and 43*b* are printed along the length of the electrodes. The resistors 43*a* and 43*b* may have different resistivities.

The surface of the base plate is covered with an over coating layer 46 except for the portions of the common electrodes 44, the individual electrodes 45*a* and 45*b*, and it is sintered. At the backside of the base plate, there is provided a temperature detecting element 47.

The heater 41 thus produced has a large area in which the resistors 43*a* and 43*b* are connected with the electrodes contacts 451*a*, 441, 451*b* and 441. The break of the resistors due to the non-uniformity of the resistor and electrode printing, can be avoided, so that the reliability of the heater is improved.

Thus, by formation of the resistor between two or more patterns faced to each other, at least two resistances can be provided. At this time, the resistance is selectable by changing the space between the faced electrodes. In this system, the resistances can be provided by one printing operation, and in addition, two resistances can be provided by one projected portion, and therefore, the temperature distribution becomes uniform.

Figure 40:
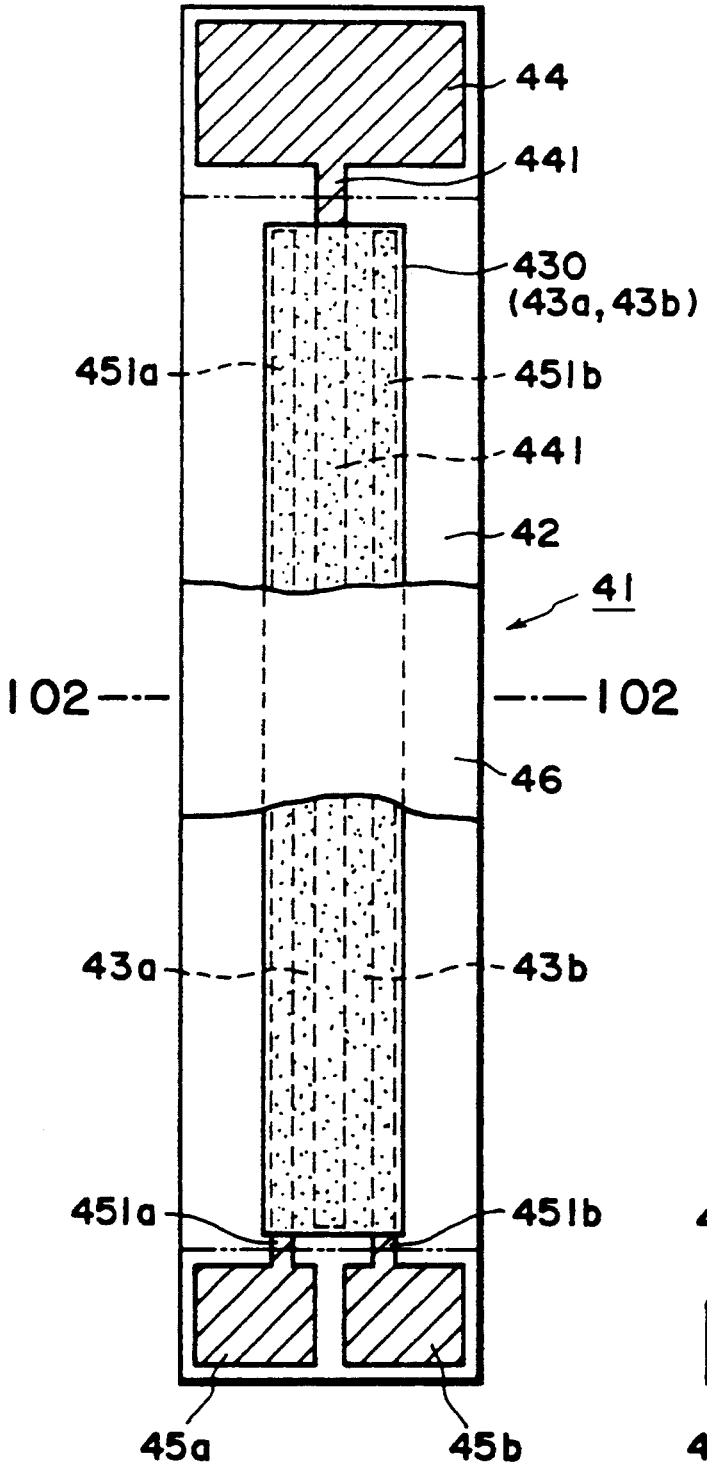
FIG. 40 is a top plan view of a heater according to a further embodiment of the present invention.
Figure 41:
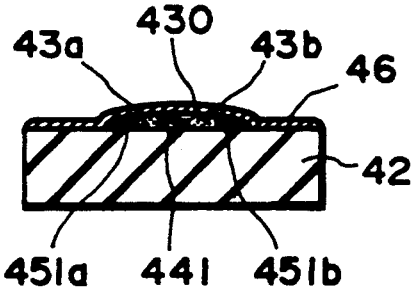
FIG. 41 is a sectional view of the device shown in FIG. 40.

In a heater 41 of FIGS. 40 and 41, one resistance material pattern 430 is printed to cover all of the three parallel extended electrodes 451*a*, 441 and 451*b*, so that different resistances are provided between the electrodes 451*a* and 441 and between the extended electrodes 441 and 451*b*, as resistor portions 43*a* and 43*b*.

With this structure of the feature, the projections of the heaters 43*a* and 43*b*, can be removed, and therefore, the pressure distribution in the fixing nip N is made uniform, and therefore, the fixing performance is improved. By the provision of two resistances by a single resistance material, the temperature distribution is made uniform, and the fixing performance is improved.

By changing the spaces between the extended electrodes 441, 451*a*, 441 and 451*b* of the electrode contact 44, 45*a* and 45*b*, depending on the location, as shown in FIG. 42, it is possible to change the resistances of the heat generating resistors 43*a* and 43*b* formed between the spaces can be changed, by which the temperature decrease at the end portions due to the end effects, can be prevented.

Figure 43:
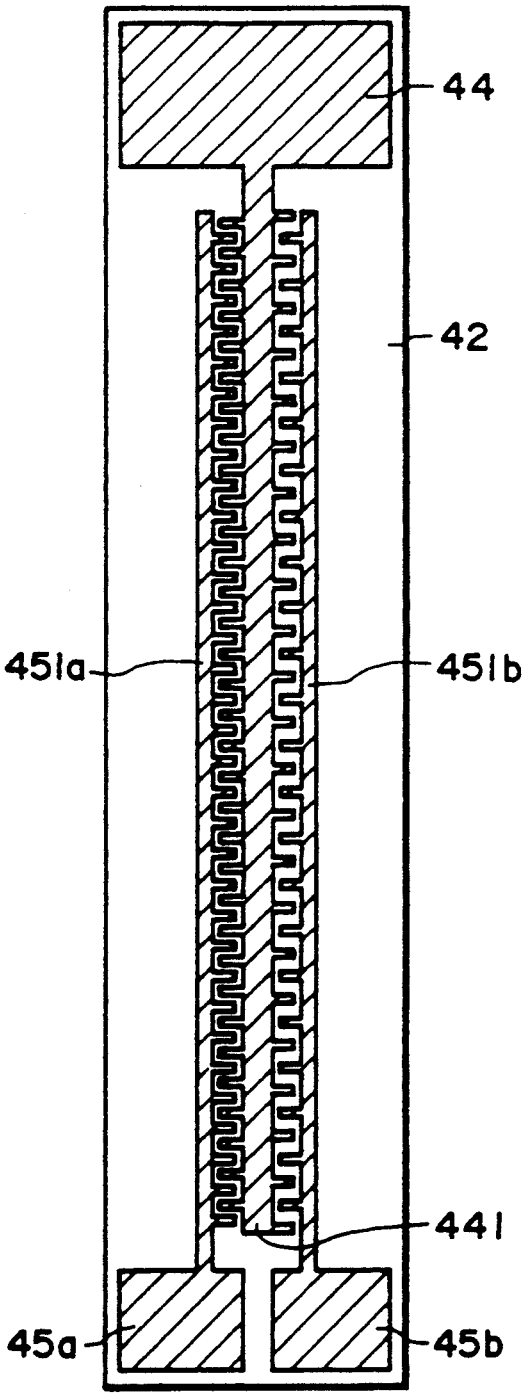
Figure 44:
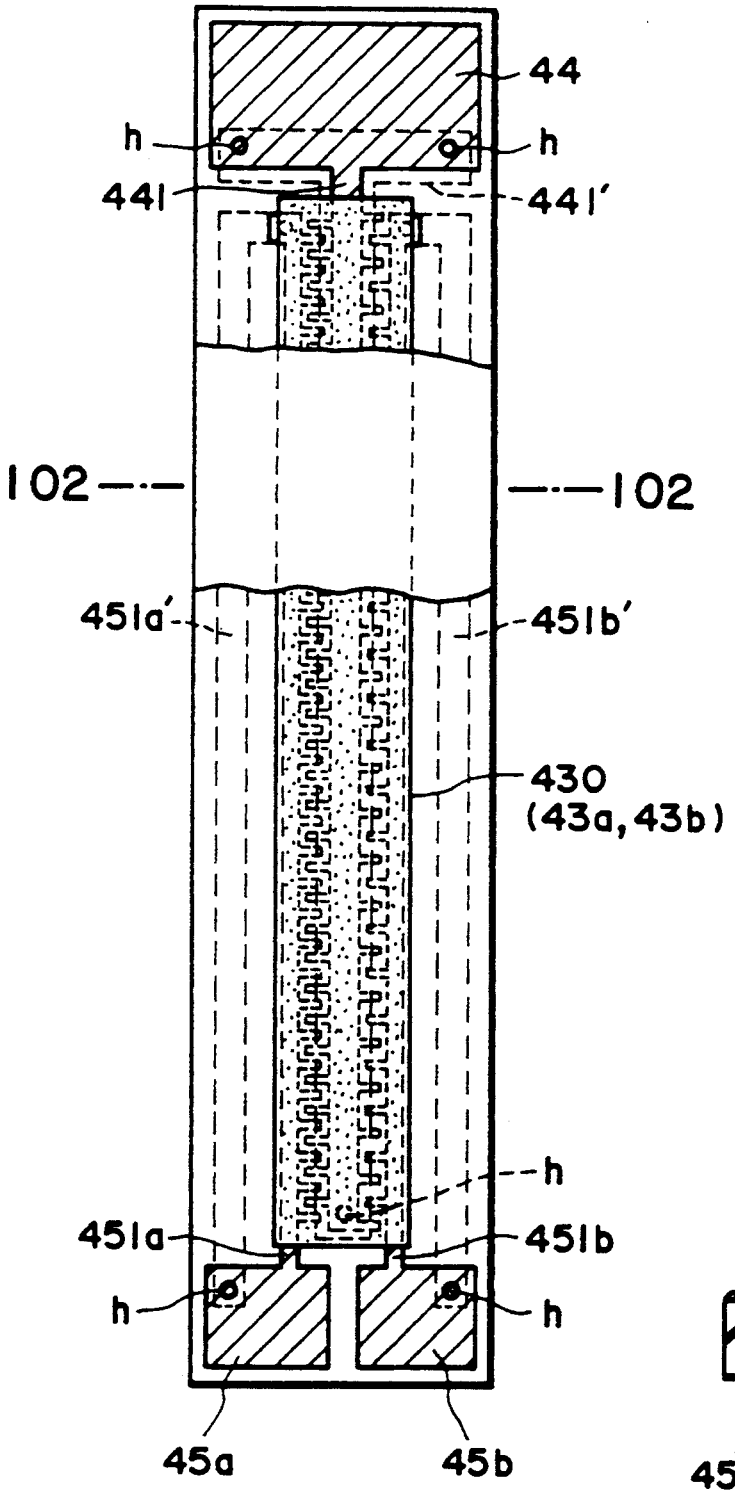
FIG. 44 is a top plan view of a heater according to a further embodiment of the present invention.
Figure 45:
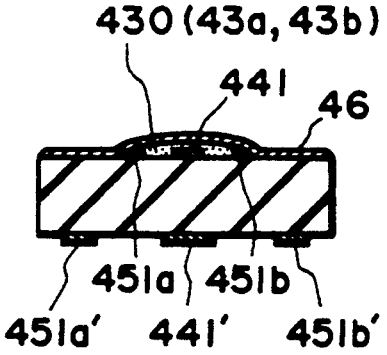
FIG. 45 is a sectional view of a device of FIG. 44.

As shown in FIG. 43, projections may be formed along the length in the extended electrodes 451*a*, 441 and 451*b* of the electrodes 44, 45*a* and 45*b* in the form of comb teeth, thus controlling the spaces between the extended electrodes 441, 451*a*, 441 and 451*b*, so that the more precise resistance distribution is accomplished.

In order to make the current flow more uniform, through holes h may be formed at end portions of the electrode contacts 44, 45*a* and 45*b* and the extended electrodes 441, 451*a* and 451*b*. In addition, auxiliary extended electrodes 441', 451*a'*, 451*b'* may be formed on the backside of the base plate 42.

Figure 46:
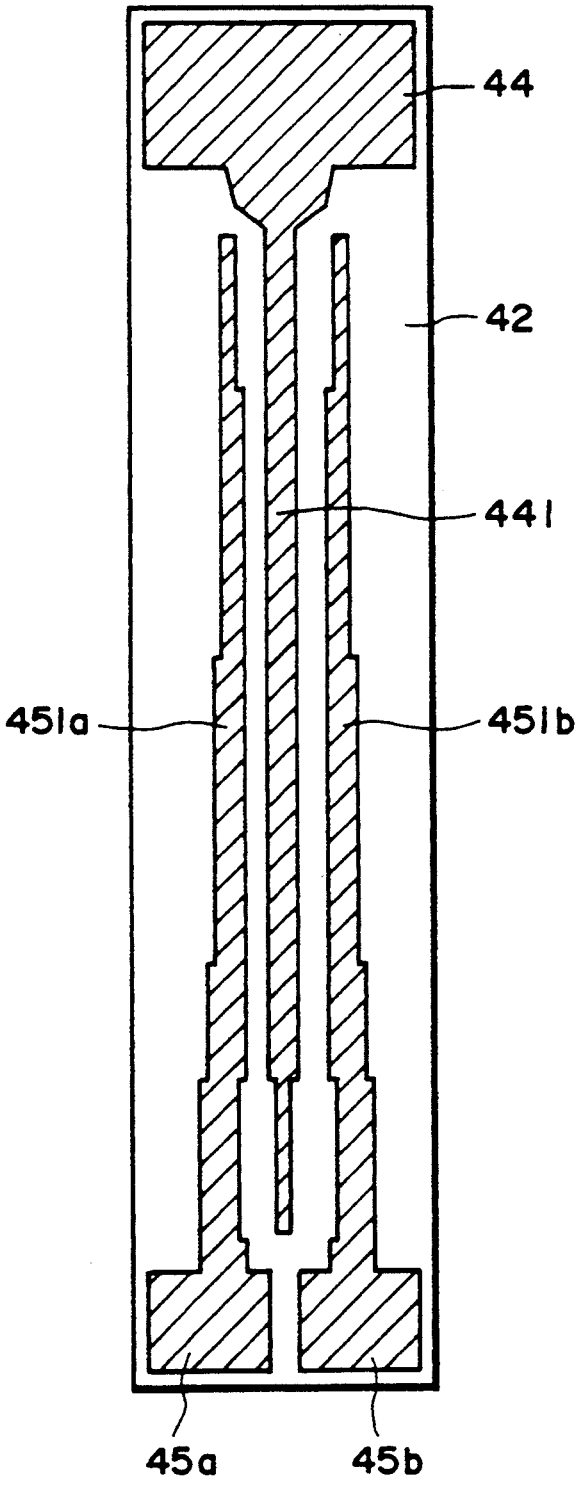

As shown in FIG. 46, even if the extended electrode portion adjacent to the electrode contacts 44, 45*a* and 45*b* where the electric current is concentrated, is expanded, the resistances between the extended electrodes 441, 451*a*, 441 and 451*b* are not influenced, and therefore, the end effects can be corrected with the prevention of the pattern break due to the current concentration, so that the reliability of the heater is improved.

With the heater structure described above, it is possible that the resistors having different resistances can be disposed at high density, and therefore, the temperature distribution of the resistors can be made uniform.

In addition, the resistances are selectable from wide range, and therefore, the controllable range can be expanded so that the precise temperature control is possible.

The electric current supplied to the individual electrode contacts is smaller than that in the case of the heater comprising one resistor, and therefore, the tolerable current for the connecting portion can be reduced, so that the reliability at the connecting portion can be improved.

Figure 47:
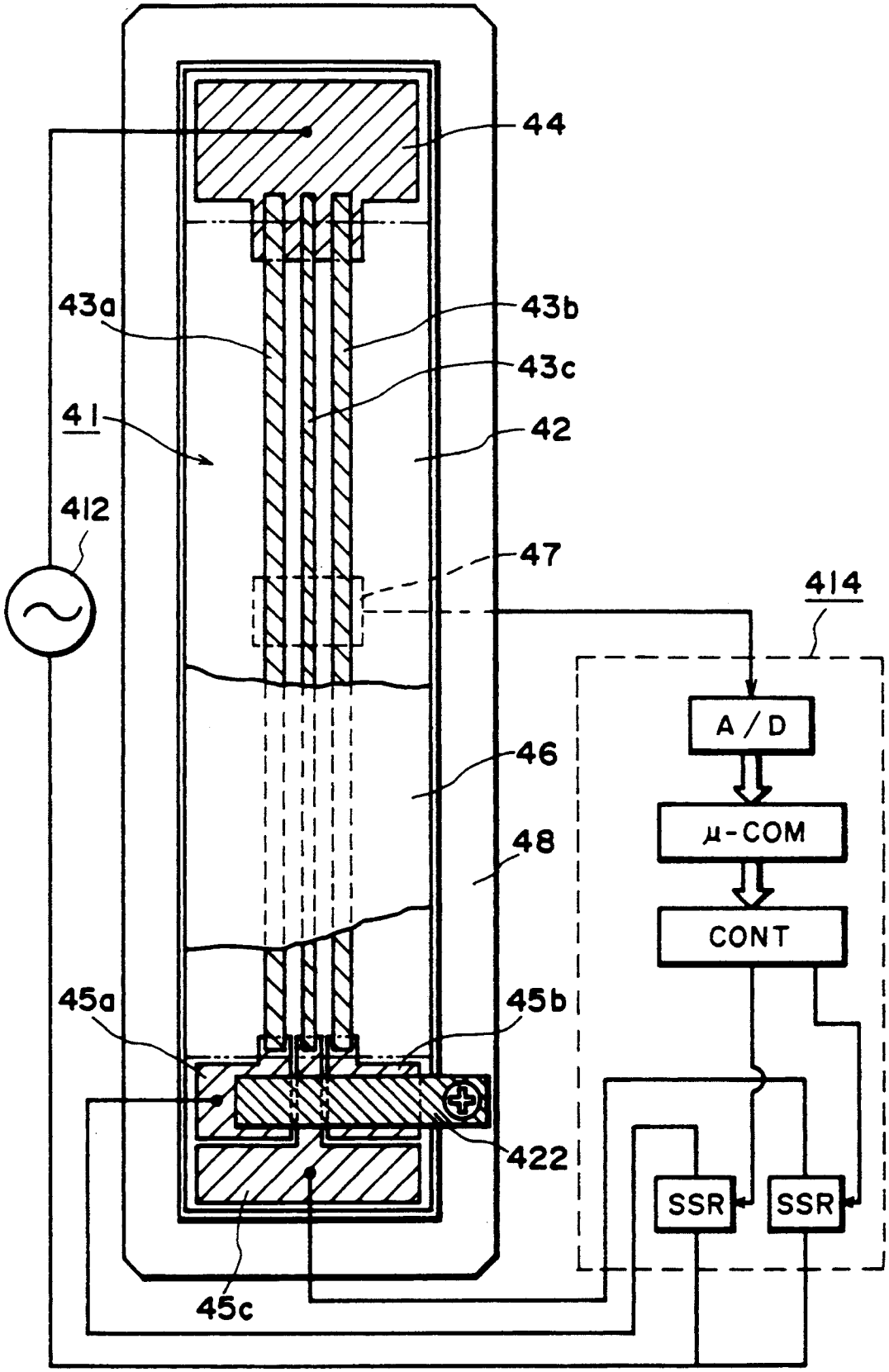
FIG. 47 is a top plan view of a heater and temperature control circuit according to a further embodiment of the present invention.
Figure 48:
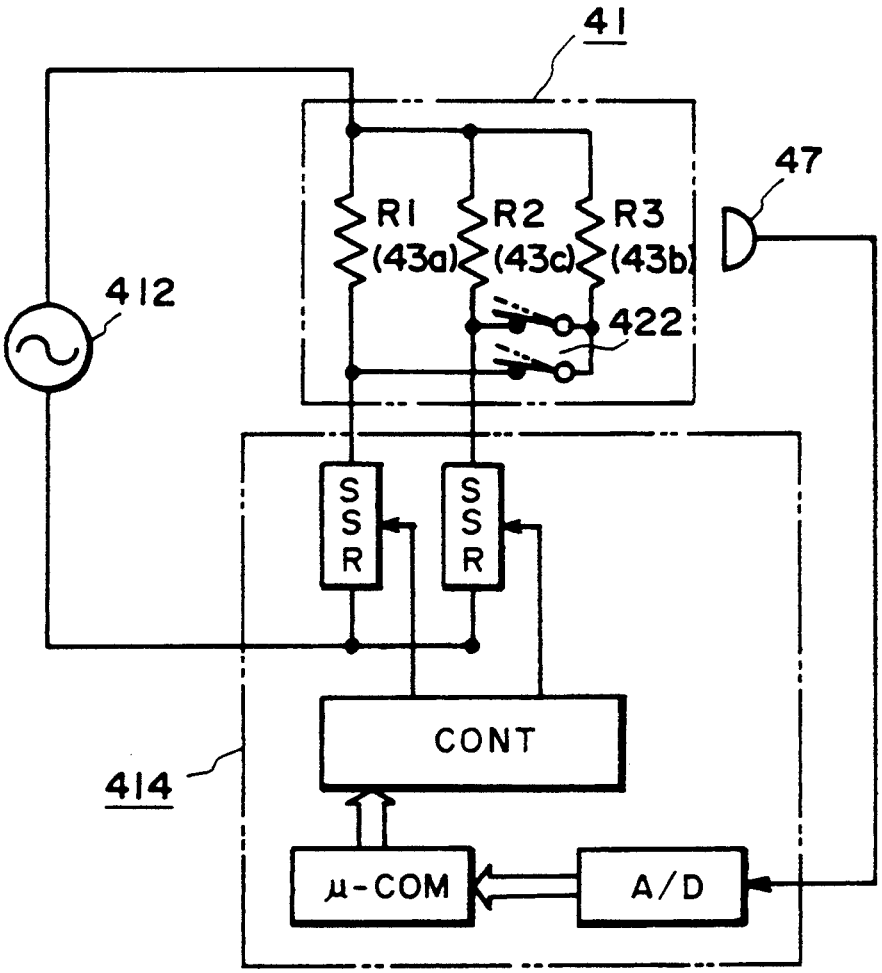
FIG. 48 is an equivalent circuit diagram of the apparatus shown in FIG. 47.

FIGS. 47 and 48 show control systems according to further embodiments of the present invention. In the actual use of the heater, the temperature is increased from the room temperature to a predetermined temperature quickly, in the usual condition. At the predetermined temperature, the system is controlled with small ripple. In another example, the temperature is increased to the predetermined temperature from the temperature higher than the room temperature, and the control is effected with little ripple.

From the relation of Power = V × V/R, the resistance R is small when large power is required. Thus, plural resistors are connected in parallel to reduce the resistance. When, on the other hand, small power is required, a resistance having a large resistance is energized alone.

In consideration of the actual use and the above described control, the parallel connection is established when the temperature is to be increased. From the necessity of preventing the overshooting from the predetermined temperature, the single resistor state is established before the predetermined temperature is reached. In the state in which the temperature control is effected to prevent the ripple, fine on-off control is required with the use of high resistance resistor alone. When the heater is started up from the state of temperature higher than the room temperature, the required power is small if the temperature difference from the predetermined temperature is small.

In other words, the switching from the parallel state to the single state, is dependent on the temperature, and the switching speed required is not so high that the electric switch is not required.

In consideration of the above, bi-metal comprising two metals bonded together and having different thermal expansion coefficient so as to be bent by the thermal expansions, or a shape memory alloy having a shape dependent on temperature, is usable, if it short-circuits the ends of the resistors between the room temperature and the predetermined temperature. Then, the number of expensive electric switches (SSR, TRIACs or the like) can be reduced, with the advantage of cost reduction.

If the number of electric switches is the same, the number of resistors can be increased, with the advantage of more precise temperature control.

Accordingly, the load resistance value of the heater can be changed for a half wave of the wave form of the voltage of the voltage source, and therefore, the control responsivity to the temperature of the heater detected, can be improved, and therefore, a low cost heater with high temperature stability can be provided with a temperature control system without switching noise as the phase control system.

In FIG. 47, a bi-metal switch 422 which opens at 100°–140° C. is mounted to a heater holder 48, so that the individual electrode contacts 45*a*, 45*c* and 45*b* may be short-circuited. FIG. 48 shows an equivalent circuit.

In this embodiment, when the temperature is increased from the room temperature, the switch 21 is closed, and therefore, the entire resistance is $$R = R1 \cdot R2 \cdot R3 / (R1 + R2 + R3).$$

Therefore, the temperature is steeply increased with the power $$P = V \cdot (R1 + R2 + R3) / (R1 \cdot R2 \cdot R3).$$

When the temperature reaches about 100° C., the switch 422 opens, and therefore, the resistance becomes $$R = R1 \cdot R2 / (R1 + R2).$$

Therefore, $$P = V \cdot (R1 + R2) / (R1 \cdot R2).$$

After the temperature reaches to this level, the control thereafter is satisfactorily effected using two resistors 43*c* and 43*a*. During the continuous energization, the temperature is at a high level, and therefore, the switch 422 keeps opened. On the other hand, when the energization is stopped with the result of decrease of the temperature of the ceramic base plate 42, the switch 422 is closed, so that the resistors 43*a*, 43*c* and 43*b* are short-circuit. When it is to be started up again, the load resistance is low, so that the quick start-is possible with the large power.

With such a structure, one SSR and a part of the control circuit can be omitted from the structure of FIG. 24 embodiment, and therefore, the cost can be decreased.

It will be understood that if the number of the resistors is 2 or more, the similar advantageous effects are provided. The configuration of the switch can be any if it is operable at predetermined temperature.

Where the switch 422 is the one using a shape memory alloy, the switching operation is satisfactory even if the shape of the resistor is more complicated, and the switching operation is possible for a larger number of contacts. By changing the contents of components of the alloy, the switching temperatures can be finely set.

By the use of the mechanical switch in place of the electric switch in the portion not requiring the high switching speed, the cost of the heater can be reduced. If the same number of switches is used, the temperature control at the set temperature can be carried out with high precision.

While the invention has been described with reference to the structures disclosed herein, it is not confined to the details set forth and this application is intended to cover such modifications or changes as may come within the purposes of the improvements or the scope of the following claims.

What is claimed is:

1. A heater apparatus comprising:

an electrically insulative base plate;

a plurality of independent resistors, extending along a length of said base plate, for producing heat upon electric energization thereof;

a temperature detecting element for detecting a temperature of said plate;

control means for controlling a supply of electric power to said plurality of independent resistors so that the temperature detected by said detecting element approaches a predetermined temperature; and selecting means for selecting at least one of said resistors to be energized and for changing a resultant resistance of the selected at least one resistor in accordance with an output of said detecting element.

2. An apparatus according to claim 1, wherein said plural resistors are extended substantially in parallel on said base plate.

3. An apparatus according to claim 1, wherein said resistors are laminated one above another.

4. An apparatus according to claim 1, wherein said resistors have different resistances per unit length.

5. An apparatus according to claim 4, wherein each said resistor has a different cross-sectional area from the other resistors.

6. An apparatus according to claim 5, wherein each said resistor has a different width from the other resistor.

7. An apparatus according to claim 5, wherein each said resistor has a different thickness from the other resistors.

8. An apparatus according to claim 1, wherein said selecting means includes a switch which is on-off-controlled with a unit of half wave of a power source.

9. An apparatus according to claim 1, wherein said control means includes zero-cross detecting means for detecting a zero-cross point of a wave form of electric power for the energization, and a switch for selecting said resistors to be energized, wherein said switch operates at any phase of the wave form.

10. An apparatus according to claim 1, wherein said resistors are provided independently from each other, wherein said apparatus further comprises a common electrode commonly connected to said resistors at one end of each said resistor, and electrodes connected to respective other ends of each said resistor.

11. A heater apparatus comprising:

an electrically insulative and thermally conductive base plate;

a plurality of independent resistors, extending along a length of one side of said base plate, for producing heat upon electric energization thereof; and temperature detecting elements corresponding to said resistors, respectively, wherein said detecting elements are disposed substantially opposite from said resistors, respectively, with said base plate therebetween.

12. An apparatus according to claim 11, wherein said resistors are independent from each other, wherein said apparatus further comprises a common electrode commonly connected to one end of each said resistor, and a plurality of electrodes, wherein respective ones of said plurality of electrodes are connected to other ends of respective ones of said resistors.

* * * * *

UNITED STATES PATENT AND TRADEMARK OFFICE

CERTIFICATE OF CORRECTION

PATENT NO. : 5,376,773

DATED : December 27, 1994

INVENTOR(S) : KAZUNORI MASUDA, ET AL.

It is certified that error appears in the above-indentified patent and that said Letters Patent is hereby corrected as shown below:

Column 1, line 8, "for suitably" should read --suitable for--;
line 15, "which" should be deleted;
line 17, "heater." should read --heater,--; and
line 44, "hte" should read --the--.

Column 2, line 18, "heating" should read --heater--;
line 36, "line A-A" should read --line 101-101--;
line 41, "line A-A" should read --line 101-101--;
line 43, "line B-B" should read --line 102-102--;
line 45, "line C-C" should read --line 103-103--;
line 52, "line A-A" should read --line 101-101--;
line 54; "line B-B" should read --line 102-102--; and
line 56, "line C-C" should read --line 103-103--.

Column 3, line 21, "line (2)-(2)" should read --line (42) -(42)--;
line 23, "illustrate" should read --illustrates--;
line 32, "a heaters" should read --heaters--; and
line 61, "line A-A" should read --line 101-101--.

UNITED STATES PATENT AND TRADEMARK OFFICE

CERTIFICATE OF CORRECTION

PATENT NO. : 5,376,773

DATED : December 27, 1994

INVENTOR(S) : KAZUNORI MASUDA, ET AL.

It is certified that error appears in the above-indentified patent and that said Letters Patent is hereby corrected as shown below:

Column 4, line 2, "1-3," should read --1-3--;
line 23, "shows" should read --show--;
line 26, "line A-A" should read --line 101-101--;
line 27, "line B-B" should read --line 102-102--;
line 28, "line C-C" should read --line 103-103--;
line 63, "line A-A" should read --line 101-101--;
line 64, "line B-B" should read --line 102-102--; and
line 65, "line C-C" should read --line 103-103--.

Column 5, line 44, "triffering" should read --triggering--;
line 52, "becomesa" should read --becomes--; and
line 53, "for" should read --form--.

Column 8, line 4, "in" should be deleted.

Column 9, line 63, "FIG. 26," should read --FIG. 25--.

Column 10, line 7, "leads" should read --lead--.

UNITED STATES PATENT AND TRADEMARK OFFICE

CERTIFICATE OF CORRECTION

PATENT NO. : 5,376,773

DATED : December 27, 1994

INVENTOR(S) : KAZUNORI MASUDA, ET AL.

It is certified that error appears in the above-indentified patent and that said Letters Patent is hereby corrected as shown below:

Column 11,
line 15, "creaseing" should read --creasing--; and
line 48, "b-b" should read --B--.

Column 12,
line 50, "is" should read --are--.

Column 13,
line 3, "contacts" should read --contact--;
line 40, "is" should read --are--;
line 48, "increase" should read --increases--; and
line 59, "is" should read --are--.

Column 14,
line 12, "contacts" should read --contact--; and
line 35, "plat" should read --plate--.

Column 17,
line 6, "circuit" should read --circuited--; and
line 43, "plate" should read --base plate--.

Signed and Sealed this

Thirteenth Day of June, 1995

*Attest:*

*Attesting Officer*

BRUCE LEHMAN

*Commissioner of Patents and Trademarks*